US008174548B2

(12) United States Patent
Tsujino et al.

(10) Patent No.: US 8,174,548 B2
(45) Date of Patent: May 8, 2012

(54) EXPOSURE HEAD AND AN IMAGE FORMING APPARATUS

(75) Inventors: Kiyoshi Tsujino, Matsumoto (JP); Nozomu Inoue, Matsumoto (JP); Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 666 days.

(21) Appl. No.: 12/335,289

(22) Filed: Dec. 15, 2008

(65) Prior Publication Data

US 2009/0160926 A1 Jun. 25, 2009

(30) Foreign Application Priority Data

Dec. 25, 2007 (JP) ..... 2007-332586
Oct. 23, 2008 (JP) ..... 2008-273125

(51) Int. Cl.
*G03G 13/03* (2006.01)

(52) U.S. Cl. ..... 347/135

(58) Field of Classification Search ..... None
See application file for complete search history.

(56) References Cited

U.S. PATENT DOCUMENTS 6,041,204 A 3/2000 Haneda et al.
7,068,410 B2 * 6/2006 Nomura et al. ..... 359/225.1
7,081,912 B2 * 7/2006 Seki et al. ..... 347/244
7,145,589 B2 * 12/2006 Amada et al. ..... 347/241
2004/0174426 A1 * 9/2004 Nomura et al. ..... 347/238
2005/0263718 A1 12/2005 Tsujino et al.
2007/0024696 A1 * 2/2007 Ishibe ..... 347/241
2007/0236553 A1 * 10/2007 Kawano et al. ..... 347/133

FOREIGN PATENT DOCUMENTS

EP 1598200 A2 11/2005
JP 02-004546 1/1990
JP 2005178186 A 7/2005
JP 2006281730 A 10/2006

OTHER PUBLICATIONS

European search report for corresponding European application 08021924.9-1251 lists the references above.

* cited by examiner

*Primary Examiner* — Stephen Meier
*Assistant Examiner* — Alexander C Witkowski
(74) *Attorney, Agent, or Firm* — DLA Piper LLP (US)

(57) ABSTRACT

An image forming apparatus, includes: a latent image carrier that moves in a first direction; an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system; and a controller that is adapted to control a light quantity of the light emitting element that emits a light to be imaged on the latent image carrier by the first imaging optical system in accordance with an imaging characteristic of the first imaging optical system.

6 Claims, 21 Drawing Sheets

EXPOSURE HEAD AND AN IMAGE FORMING APPARATUS

CROSS REFERENCE TO RELATED APPLICATION

The disclosure of Japanese Patent Applications No. 2007-332586 filed on Dec. 25, 2007 and No. 2008-273125 filed on Oct. 23, 2008 including specification, drawings and claims is incorporated herein by reference in its entirety.

BACKGROUND

1. Technical Field

This invention relates to an exposure head for forming a spot by emitting a light from a light emitting element and an image forming apparatus using this exposure head.

2. Related Art

There has been conventionally known technology for forming spots on an image plane moving in a sub scanning direction by a line head (exposure head) to expose the image plane. As such a line head, the one in which a plurality of light emitting elements are arranged in a main scanning direction orthogonal to or substantially orthogonal to the sub scanning direction like a line head, for example, disclosed in JP-A-2-4546 can be used. In other words, in an exposure operation using such a line head, a plurality of light emitting elements of the line head are driven for light emission to form a plurality of spots arranged in the main scanning direction on the image plane. The entire image plane is exposed by repeatedly performing such a spot forming operation.

SUMMARY

In order to achieve a higher resolution, a line head can be used in which a plurality of light emitting elements are arranged at positions mutually different in a moving direction (first direction) of an image plane. However, in such a line head, the respective light emitting elements arranged at the positions mutually different in the first direction form spots at positions mutually different in the first direction. Due to such differences in spot formation positions in the first direction, various exposure failures occurred in some cases.

An advantage of some aspects of the invention is to provide technology for suppressing the occurrence of an exposure failure resulting from differences in spot formation positions in a first direction.

According to a first aspect of the invention, there is provided an image forming apparatus, comprising: a latent image carrier that moves in a first direction; an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system; and a controller that is adapted to control a light quantity of the light emitting element that emits a light to be imaged on the latent image carrier by the first imaging optical system in accordance with an imaging characteristic of the first imaging optical system.

According to a second aspect of the invention, there is provided an image forming apparatus, comprising: a latent image carrier that moves in a first direction; an exposure head that includes an imaging optical system and a light emitting element that emits a light to be imaged on the latent image carrier by the imaging optical system; and a controller that is adapted to control a light quantity of the light emitting element in accordance with a position in the first direction of the imaging optical system which images the light emitted from the light emitting element.

According to a third aspect of the invention, there is provided an exposure head, comprising: a first imaging optical system; a second imaging optical system that is distanced from the first imaging optical system in a first direction in which a surface-to-be-exposed is moved; a light emitting element that emits a light to be imaged by the first imaging optical system; a light emitting element that emits a light to be imaged by the second imaging optical system; and a controller that is adapted to control a light quantity of the light emitting element that emits the light to be imaged by the first imaging optical system in accordance with an imaging characteristic of the first imaging optical system.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Terms used in this specification are first described below (see "A. Description of Terms"). Following this description of terms, a basic construction of an image forming apparatus including a line head as an application subject of the invention (see "B. Basic Construction") and a basic operation of the line head (see "C. Basic Operation") are described. Following the description of the basic construction and the basic operation, embodiments of the invention are described.

A. Description of Terms

Figure 1:
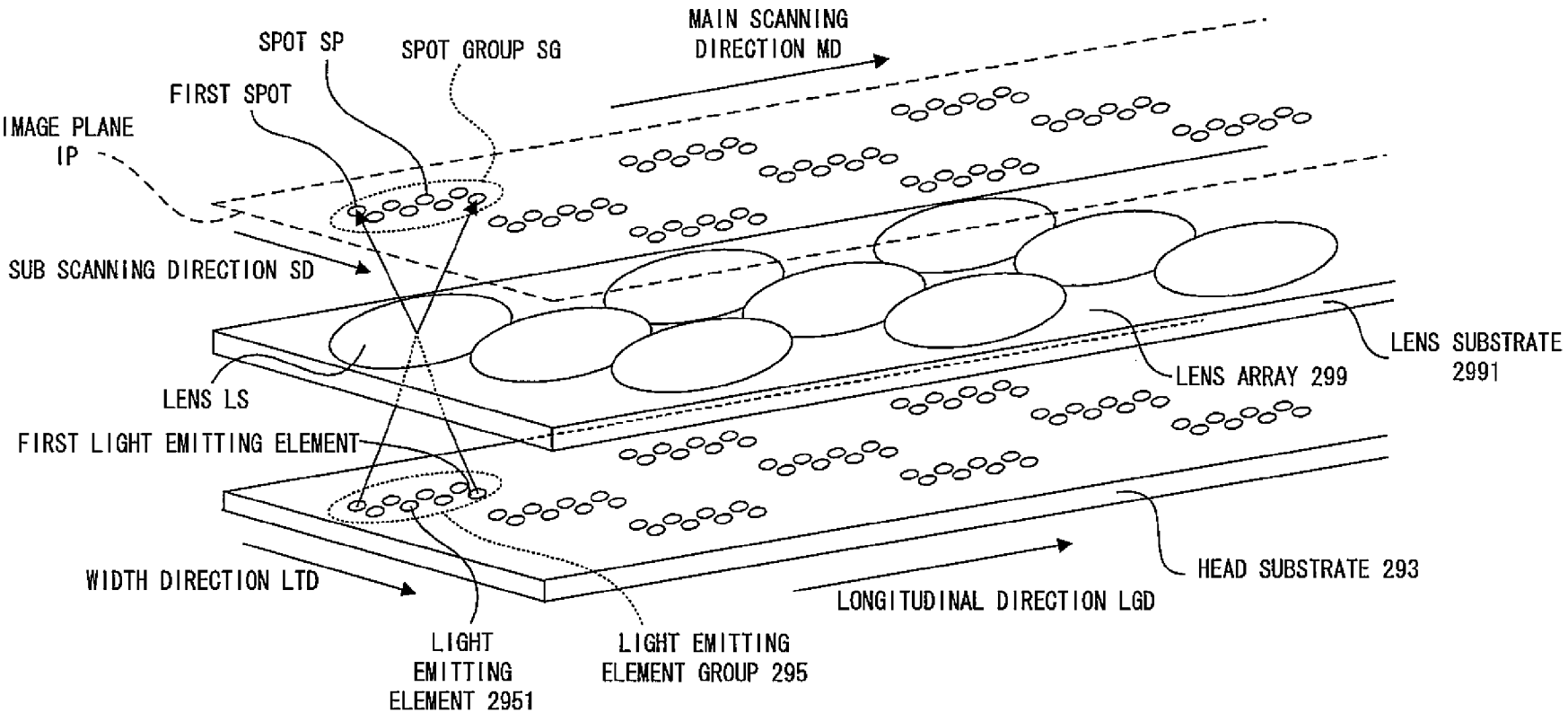
FIGS. 1 and 2 are diagrams showing terminology used in this specification.
Figure 2:
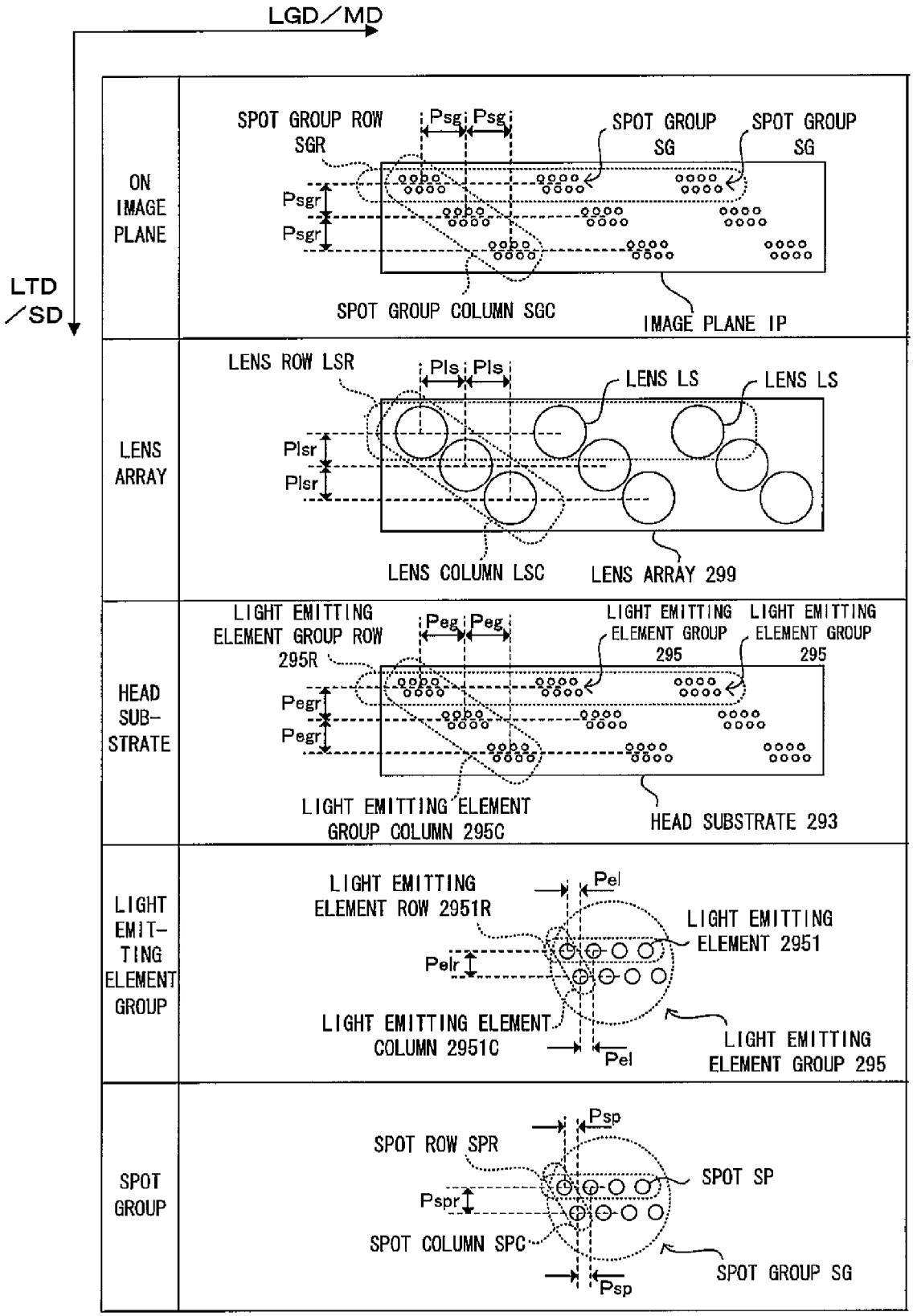

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction orthogonal to or substantially orthogonal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on the head substrate 293 in one-to-one correspondence with the plurality of lenses LS of the lens array 299 are defined to be light emitting element groups 295. In other words, in the head substrate 293, the plurality of light emitting element groups 295 including a plurality of light emitting elements 2951 are arranged in conformity with the plurality of lenses LS, respectively. Further, collections of a plurality of spots SP formed on the image plane IP by light beams from the light emitting element groups 295 imaged on the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

A spot group row SGR and a spot group column SGC are defined as shown in the column "On Image Plane" of FIG. 2. Specifically, a plurality of spot groups SG arranged in the main scanning direction MD are defined as the spot group row SGR. A plurality of spot group rows SGR are arranged at specified spot group row pitches Psgr in the sub scanning direction SD. Further, a plurality of (three in FIG. 2) spot groups SG arranged at spot group row pitches Psgr in the sub scanning direction SD and at spot group pitches Psg in the main scanning direction MD are defined as the spot group column SGC. The spot group row pitch Psgr is a distance in the sub scanning direction SD between the geometric centers of gravity of two spot group rows SGR adjacent in the sub scanning direction SD, and the spot group pitch Psg is a distance in the main scanning direction MD between the geometric centers of gravity of two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of two lens rows LSR adjacent in the width direction LTD, and that the lens pitch Pls is a distance in the longitudinal direction LGD between the geometric centers of gravity of two lenses LS adjacent in the longitudinal direction LGD.

Light emitting element group rows 295R and light emitting element group columns 295C are defined as in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of two light emitting element group rows 295R adjacent in the width direction LTD, and that the light emitting element group pitch Peg is a distance in the longitudinal direction LGD between the geometric centers of gravity of two light emitting element groups 295 adjacent in the longitudinal direction LGD.

Light emitting element rows 2951R and light emitting element columns 2951C are defined as in the column "Light Emitting Element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951 are arranged at specified light emitting element row pitches Pelr in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of two light emitting element rows 2951R adjacent in the width direction LTD, and that the light emitting element pitch Pel is a distance in the longitudinal direction LGD between the geometric centers of gravity of two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of two spot rows SPR adjacent in the sub scanning direction SD, and that the spot pitch Psp is a distance in the main scanning direction MD between the geometric centers of gravity of two spots SP adjacent in the main scanning direction NM.

B. Basic Construction

Figure 3:
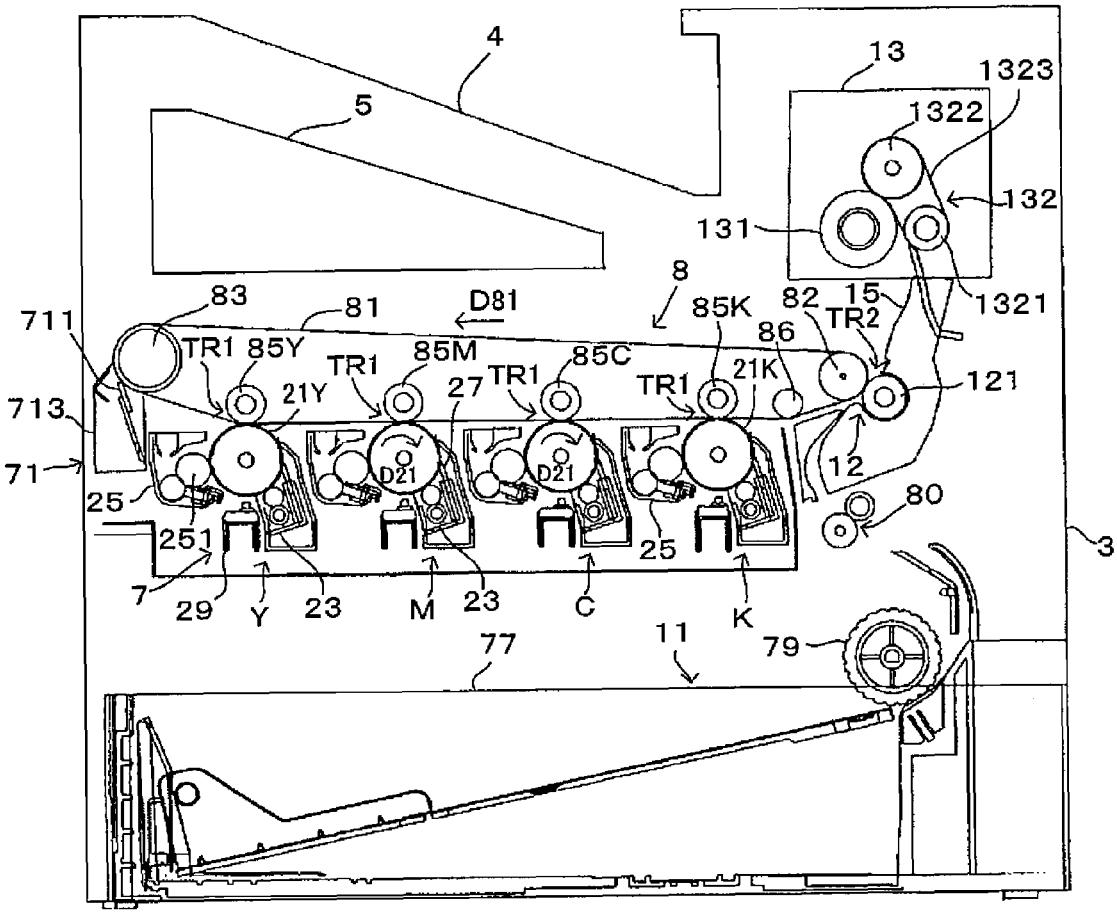
FIG. 3 is a diagram showing an embodiment of an image forming apparatus including a line head as an application subject of the invention.
Figure 4:
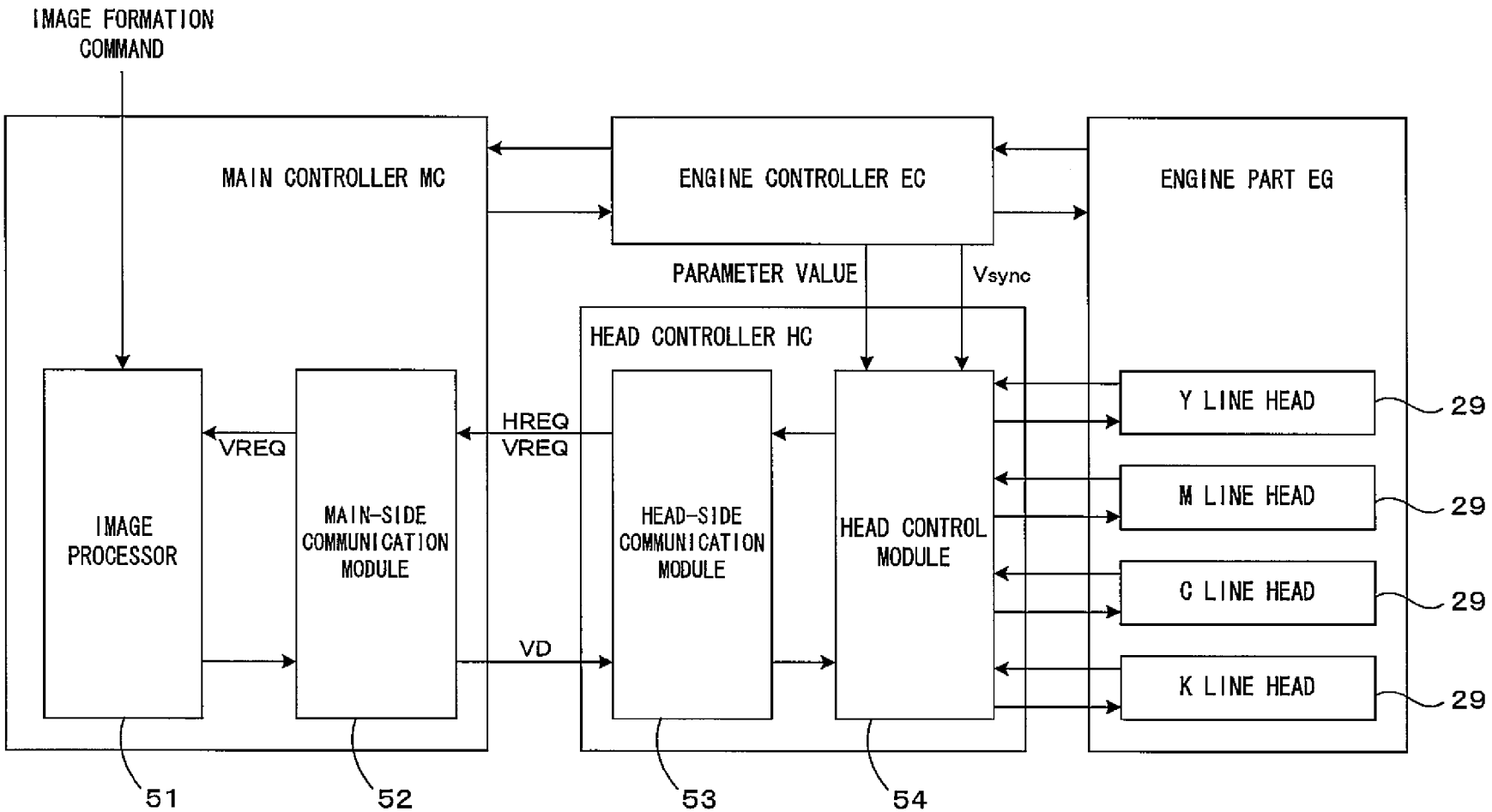
FIG. 4 is a diagram showing the electrical construction of the image forming apparatus of FIG. 3.

FIG. 3 is a diagram showing an embodiment of an image forming apparatus including a line head as an application subject of the invention. FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction NM. Each photosensitive drum 21 is connected to its own driving motor and is driven to rotate at a specified speed in a direction of arrow D21 in FIG. 3, whereby the surface of the photosensitive drum 21 is transported in the sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 3, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩcm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, when the blade facing roller 83 moves, the cleaner blade 711 and the waste toner box 713 move together with the blade facing roller 83.

Figure 5:
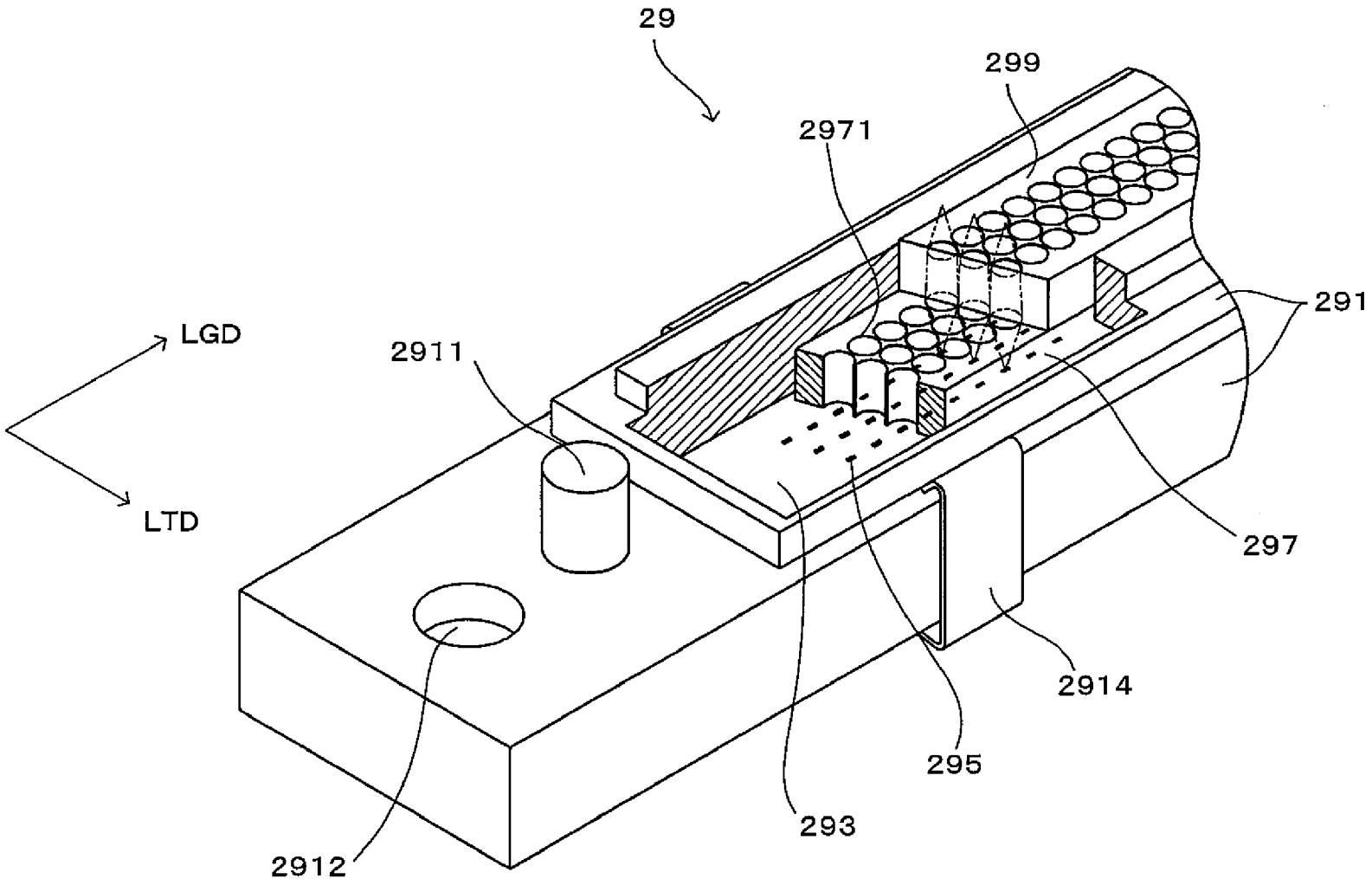
FIG. 5 is a perspective view schematically showing a line head.
Figure 6:
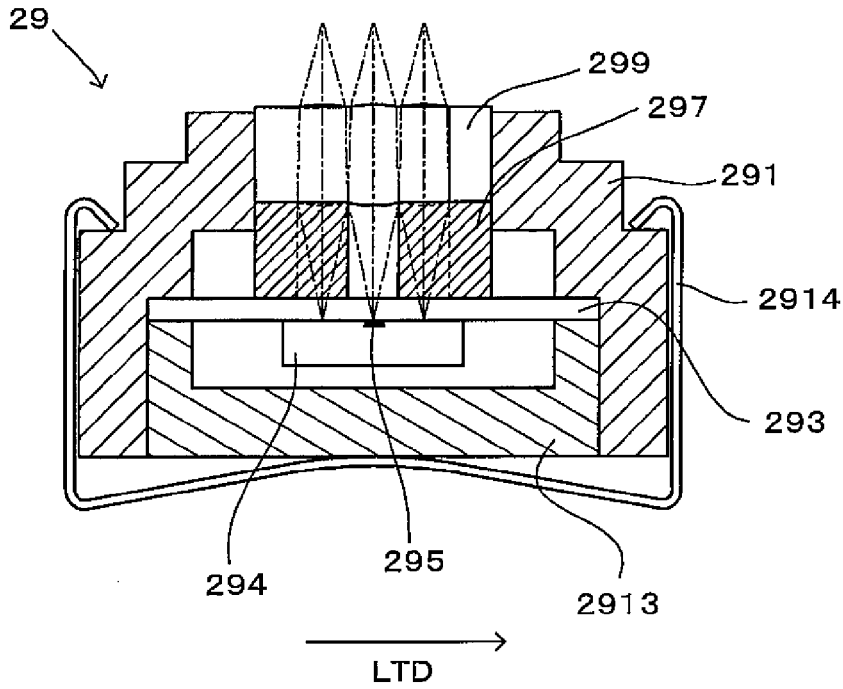
FIG. 6 is a sectional view along a width direction of the line head shown in FIG. 5.

FIG. 5 is a perspective view schematically showing a line head, and FIG. 6 is a sectional view along a width direction of the line head shown in FIG. 5. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are orthogonal to or substantially orthogonal to each other. The line head 29 includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of light emitting element groups 295, each of which is a group of a plurality of light emitting elements, are provided on an under surface of the head substrate 293 (surface opposite to the lens array 299 out of two surfaces of the head substrate 293), as described later. The light emitting elements 2951 are bottom emission-type EL (electroluminescence) devices. The light beams emitted from the respective light emitting element groups 295 propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normal to the head substrate 293. Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged by the lens array 299 to form spots on the surface of the photosensitive drum 21.

As shown in FIG. 6, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 7:
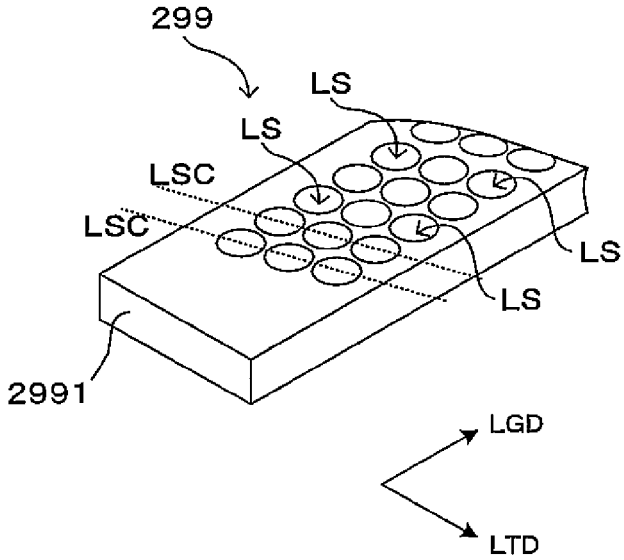
FIG. 7 is a schematic partial perspective view of the lens array.
Figure 8:
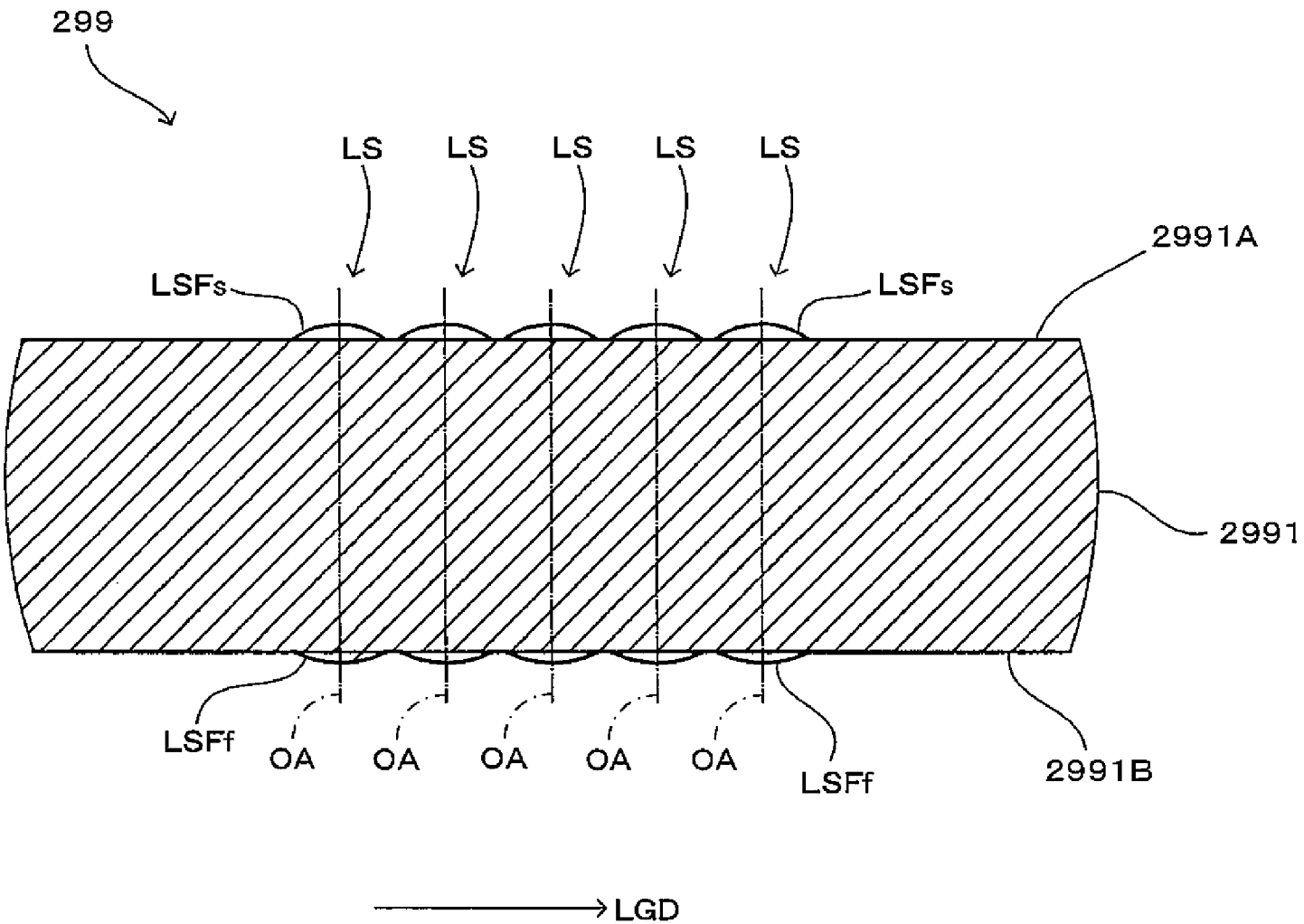
FIG. 8 is a sectional view of the lens array in the longitudinal direction.

FIG. 7 is a schematic partial perspective view of the lens array, and FIG. 8 is a sectional view of the lens array in the longitudinal direction LGD. The lens array 299 includes a lens substrate 2991. First surfaces LSFf of the lenses LS are formed on an under surface 2991B of the lens substrate 2991, and second surfaces LSFs of the lenses LS are formed on a top surface 2991A of the lens substrate 2991. The first and second surfaces LSFf, LSFs facing each other and the lens substrate 2991 held between these two surfaces function as one lens LS. The first and second surfaces LSFf, LSFs of the lenses LS can be made of resin for instance.

The lens array 299 is arranged such that optical axes OA of a plurality of lenses LS are substantially parallel to each other. The lens array 299 is also arranged such that the optical axes OA of the lenses LS are substantially orthogonal to an under surface (surface where the light emitting elements 2951 are arranged) of the head substrate 295. The lenses LS are provided in a one-to-one correspondence with the light emitting element groups 295, and a plurality of lenses LS are two-dimensionally arranged in conformity with the arrangement of the light emitting element groups 295 to be described later. In other words, a plurality of lens columns LSC each including three lenses LS arranged at mutually different positions in the width direction LTD are arranged in the longitudinal direction LGD.

Figure 9:
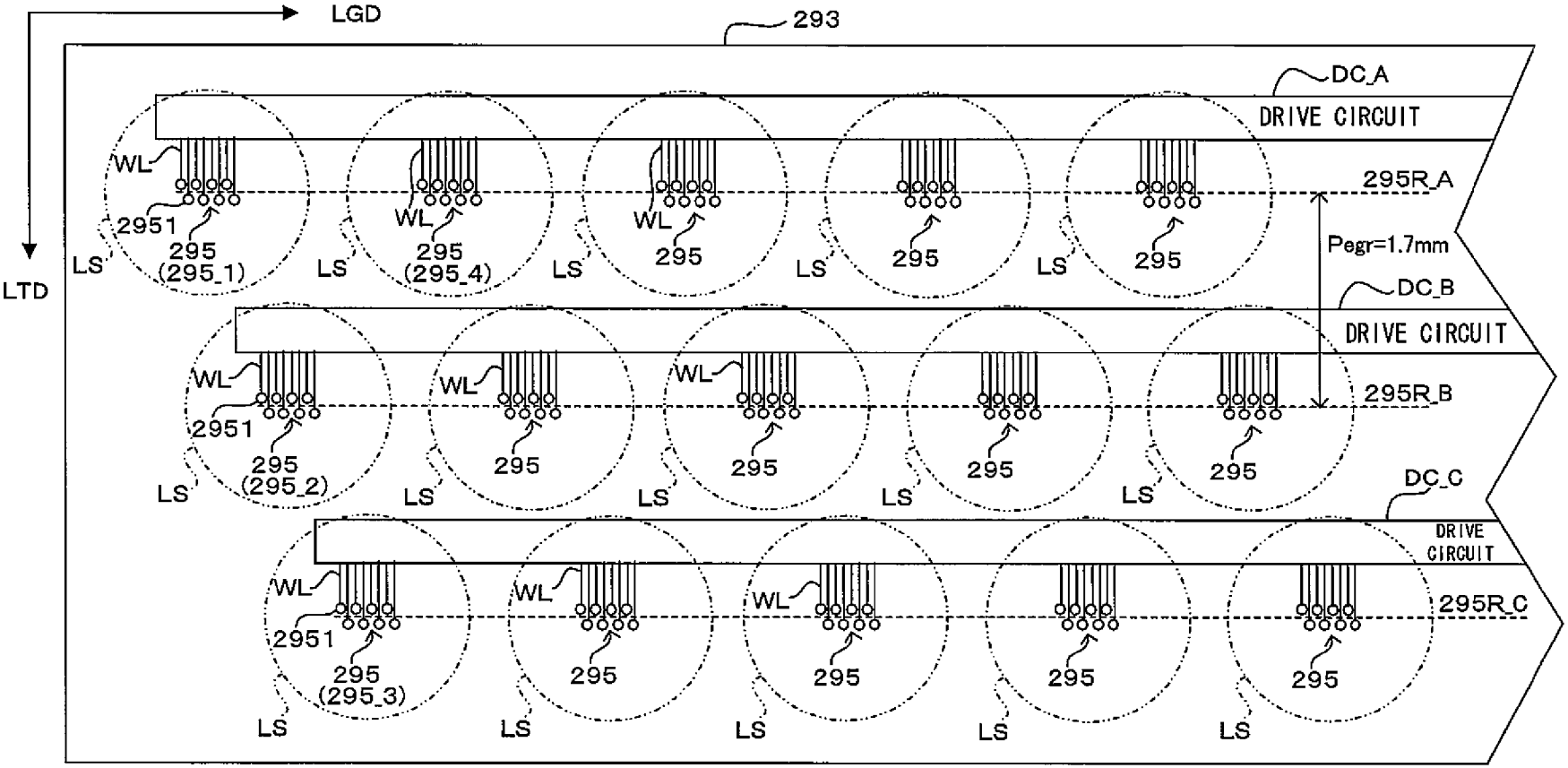
FIG. 9 is a diagram showing the construction of the under surface of the head substrate.
Figure 10:
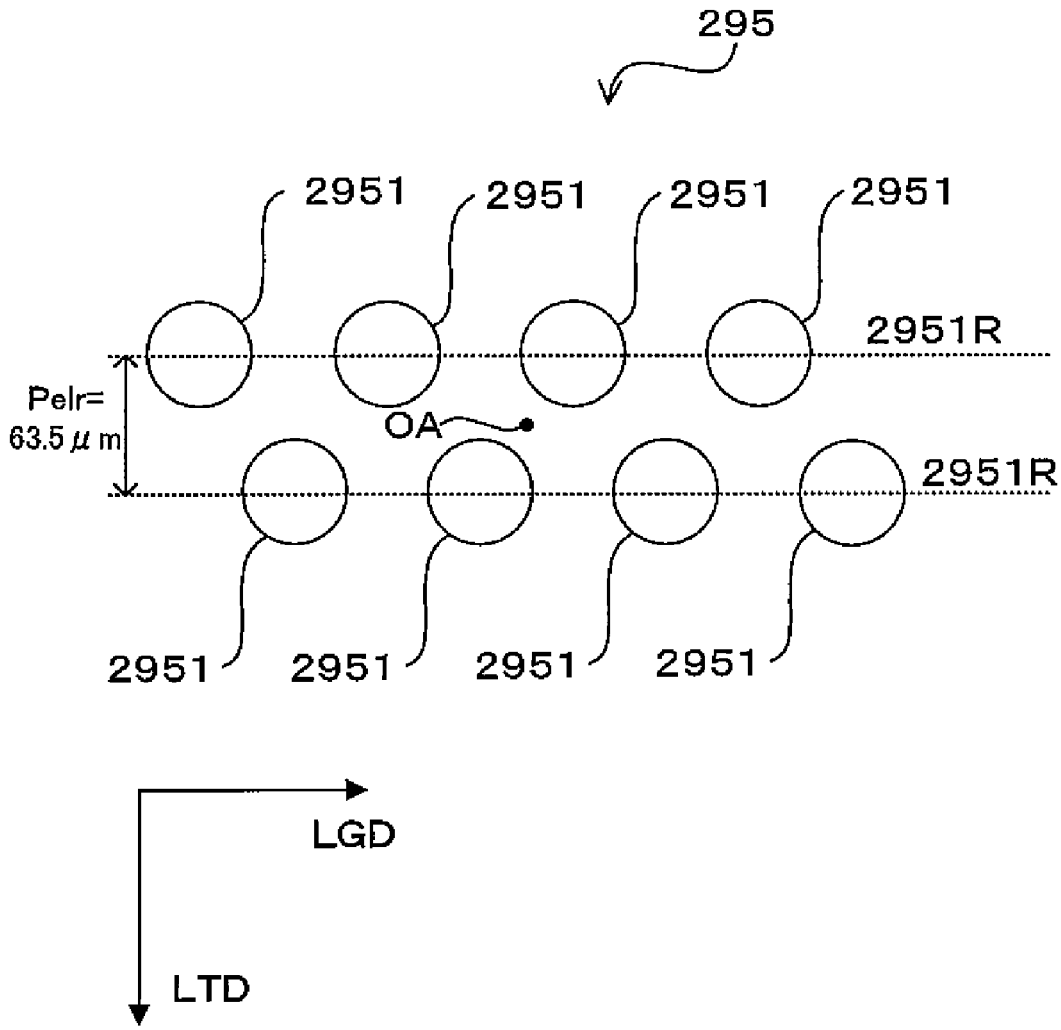
FIG. 10 is a diagram showing the arrangement of the light emitting elements in each light emitting element group.

FIG. 9 is a diagram showing the construction of the under surface of the head substrate and corresponds to a case where the under surface of the head substrate is seen from the top surface thereof. FIG. 10 is a diagram showing the arrangement of the light emitting elements in each light emitting element group. In FIG. 9, the lenses LS are shown by chain double-dashed line to show that the light emitting element groups 295 are provided in a one-to-one correspondence with the lenses LS, but not to show that the lenses LS are arranged on the under surface of the head substrate. As shown in FIG. 9, the plurality of light emitting element group columns 295C each including three light emitting element groups 295 arranged at mutually different positions in the width direction LTD are arranged in the longitudinal direction LGD. In other words, three light emitting element group rows 295R each including a plurality of light emitting element groups 295 arranged in the longitudinal direction LGD are arranged at the light emitting element group row pitch Pegr (=1.7 [mm]) in the width direction LTD. At this time, the respective light emitting element group rows 295R are displaced from each other in the longitudinal direction LGD so that the respective light emitting element groups 295 do not overlap each other in the longitudinal direction LGD. Here, the three light emitting element group rows are identified by 295R_A, 295R_B and 295R_C in this order from the upstream side in the width direction LTD.

In each light emitting element group 295, two light emitting element rows 2951R each including four light emitting elements 2951 aligned in the longitudinal direction LGD are arranged at the light emitting element row pitch Pelr (=63.5 [μm]) in the width direction LTD (FIG. 10). At this time, the respective light emitting element rows 2951R are displaced from each other in the longitudinal direction LGD so that the respective light emitting elements 2951 do not overlap each other in the longitudinal direction LGD. As a result, eight light emitting elements 2951 are arranged in an offset manner. As shown in FIG. 10, each light emitting element group 295 is arranged symmetrically with respect to the optical axis OA of the corresponding lens LS. In other words, eight light emitting elements 2951 constituting the light emitting element group 295 are arranged symmetrically with respect to the optical axis OA. Accordingly, light beams from the light emitting elements 2951 relatively distant from the optical axis OA can be also imaged with less aberrations.

Driving circuits DC_A (for the light emitting element group row 295R_A), DC_B (for the light emitting element group row 295R_B) and DC_C (for the light emitting element group row 295R_C) are provided corresponding to the respective light emitting element group rows 295R_A, 295R_B and 295R_C. These driving circuits DC_A and the like are constructed, for example, by TFTs (thin film transistors) (FIG. 9). The respective driving circuits DC_A and the like are arranged at one sides of the corresponding light emitting element groups 295R_A and the like in the width direction LTD, and are connected to the light emitting elements 2951 of the light emitting element group 295R_A and the like via wiring WL. When the driving circuits DC_A and the like feed drive signals to the respective light emitting elements 2951, the respective light emitting elements 2951 emit light beams of the same wavelength. The light emitting surfaces of the light emitting elements 2951 are so-called perfectly diffusing surface illuminants and the light beams emitted from the light emitting surfaces comply with Lambert's cosine law.

Light beams emitted from the light emitting elements 2951 are imaged by the lenses LS to form spots SP on the surface (photosensitive drum surface) of the photosensitive drum 21.

On the other hand, as described above, the photosensitive drum surface is charged by the charger 23 prior to spot formation. Accordingly, areas where the spots are formed are neutralized to form spot latent images Lsp. The spot latent images Lsp thus formed are conveyed to a downstream side in the sub scanning direction SD while being carried on the photosensitive drum surface. As described next in "C. Basic Operation", the spots SP are formed at timings in conformity with the movement of the photosensitive drum surface to form a plurality of spot latent images Lsp arranged in the main scanning direction MD.

C. Basic Operation

Figure 11:
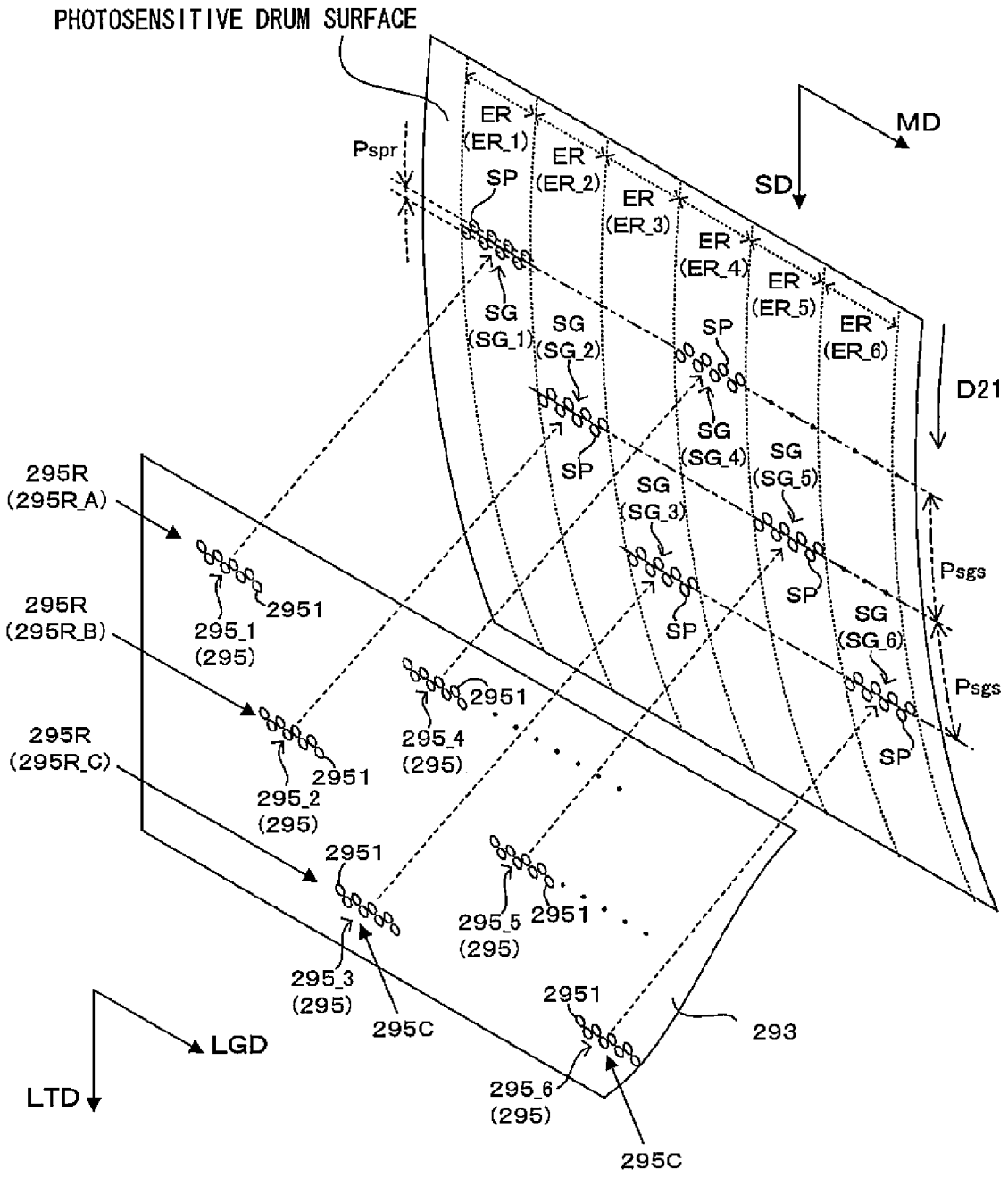
FIG. 11 is a perspective view showing spots formed by the line head.

FIG. 11 is a perspective view showing spots formed by the line head. The lens array 299 is not shown in FIG. 11.

As shown in FIG. 11, the respective light emitting element groups 295 can form the spot groups SG in exposure regions ER mutually different in the main scanning direction MD. Here, the spot group SG is a set of a plurality of spots SP formed by the simultaneous light emissions of all the light emitting elements 2951 of the light emitting element group 295. As shown in FIG. 11, three light emitting element groups 295 capable of forming the spot groups SG in the exposure regions ER consecutive in the main scanning direction MD are displaced from each other in the width direction LTD. In other words, three light emitting element groups 295_1, 295_2 and 295_3 capable of forming spot groups SG_1, SG_2 and SG_3, for example, in exposure regions ER_1, ER_2 and ER_3 consecutive in the main scanning direction MD are displaced from each other in the width direction LTD. These three light emitting element groups 295 constitute the light emitting element group column 295C, and a plurality of light emitting element group columns 295C are arranged in the longitudinal direction LGD. As a result, three light emitting element group rows 295R_A, 295R_B and 295R_C are arranged in the width direction LTD and the respective light emitting element group rows 295R_A, etc. form the spot groups SG at positions mutually different in the sub scanning direction SD as already described in the description of FIG. 9.

Specifically, in this line head 29, the plurality of light emitting element groups 295 (for example, light emitting element groups 295_1, 295_2, 295_3) are arranged at positions mutually different in the width direction LTD. The respective light emitting element groups 295 arranged at the positions mutually different in the width direction LTD form spot groups SG (for example, spot groups SG_1, SG_2, SG_3) at positions mutually different in the sub scanning direction SD.

In other words, in this line head 29, the plurality of light emitting elements 2951 are arranged at positions mutually different in the width direction LTD. For example, the light emitting elements 2951 belonging to the light emitting element group 295_1 and those belonging to the light emitting element group 295_2 are arranged at positions mutually different in the width direction LTD. The respective light emitting elements 2951 arranged at the positions mutually different in the width direction LTD form spots SP at positions mutually different in the sub scanning direction SD. For example, spots SP belonging to the spot group SG_1 and those belonging to the spot group SG_2 are formed at positions mutually different in the sub scanning direction SD.

In this way, the formation positions of the spots SP in the sub scanning direction SD differ depending on the light emitting elements 2951. Accordingly, in order to form a plurality of spot latent images Lsp side by side in the main scanning direction MD (that is, in order to form a plurality of spot latent images Lsp side by side at the same position in the sub scanning direction SD), differences in such spot formation positions need to be considered. Thus, in this line head 29, the respective light emitting elements 2951 are driven at timings in conformity with the movement of the photosensitive drum surface.

Figure 12:
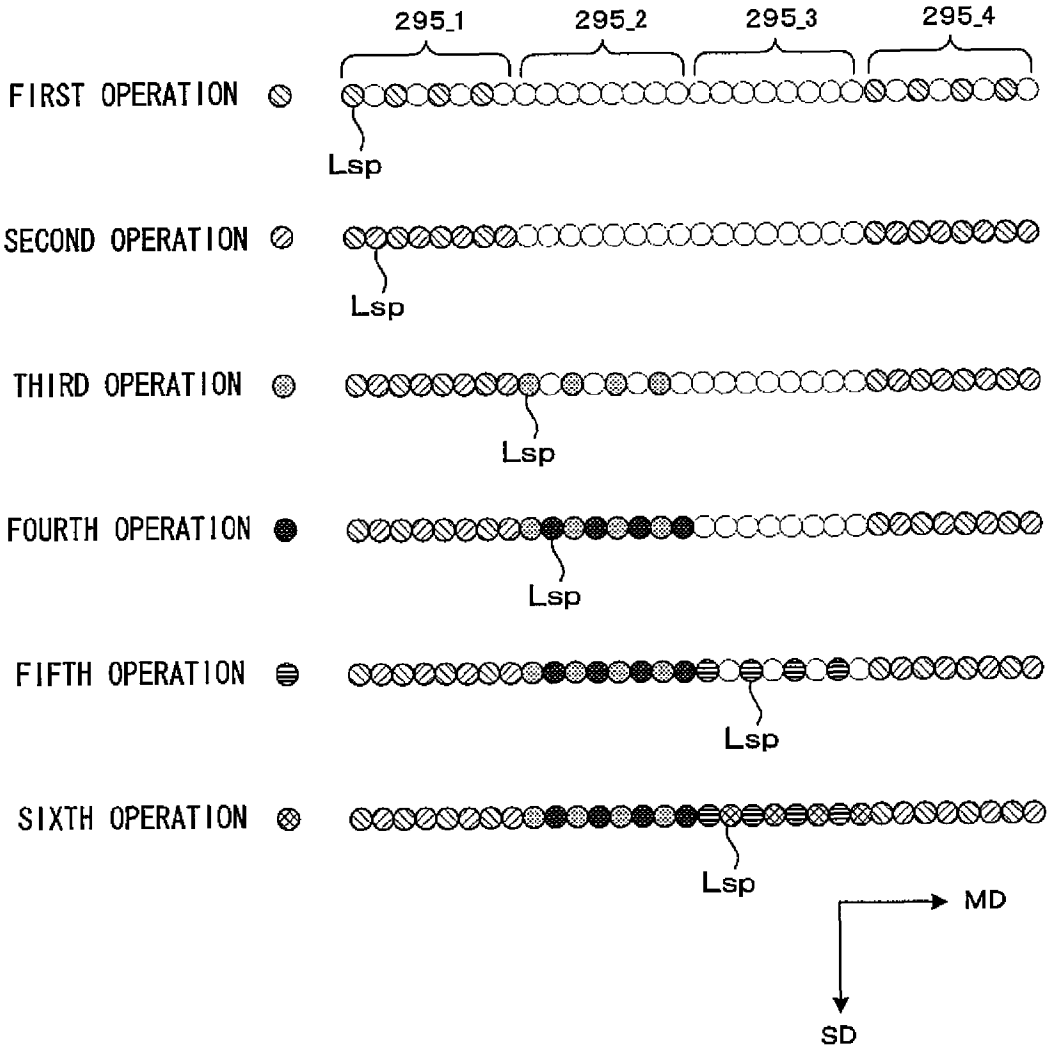
FIG. 12 is a diagram showing a spot forming operation by the above line head.

FIG. 12 is a diagram showing a spot forming operation by the above line head. The spot forming operation by the line head is described with reference to FIGS. 9, 11 and 12. Briefly, the photosensitive drum surface (latent image carrier surface) is moved in the sub scanning direction SD and the head control module 54 (FIG. 4) drives the light emitting elements 2951 for light emission at timings in conformity with the movement of the photosensitive drum surface, whereby a plurality of spot latent images Lsp arranged in the main scanning direction MD are formed.

First of all, out of the light emitting element rows 2951R (FIG. 10) belonging to the most upstream light emitting element groups 295_1, 295_4, and the like in the width direction LTD, the light emitting element rows 2951R downstream in the width direction LTD are driven for light emission. A plurality of light beams emitted by such a light emitting operation are imaged by the lenses LS to form spots SP on the photosensitive drum surface. The lenses LS have an inversion characteristic, so that the light beams from the light emitting elements 2951 are imaged in an inverted manner. In this way, spot latent images Lsp are formed at hatched positions of a "First Operation" of FIG. 12. In FIG. 12, white circles represent spots that are not formed yet, but planned to be formed later. In FIG. 12, spots labeled by reference numerals 295_1 to 295_4 are those to be formed by the light emitting element groups 295 corresponding to the respective attached reference numerals.

Subsequently, out of the light emitting element rows 2951R belonging to the most upstream light emitting element groups 295_1, 295_4, and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Second Operation" of FIG. 12. Here, the light emitting element rows 2951R are successively driven for light emission from the one downstream in the width direction LTD in order to deal with the inversion characteristic of the lenses LS.

Subsequently, out of the light emitting element rows 2951R belonging to the second most upstream light emitting element groups 295_2 and the like in the width direction, the light emitting element rows 2951R downstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Third Operation" of FIG. 12.

Subsequently, out of the light emitting element rows 2951R belonging to the second most upstream light emitting element groups 295_2 and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Fourth Operation" of FIG. 12.

Subsequently, out of the light emitting element rows 2951R belonging to the third most upstream light emitting element groups 295_3 and the like in the width direction, the light emitting element rows 2951R downstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Fifth Operation" of FIG. 12.

Finally, out of the light emitting element rows 2951R belonging to the third most upstream light emitting element groups 295_3 and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Sixth Operation" of FIG. 12. By performing the first to sixth light emitting operations in this way, a plurality of spots SP are successively formed from the upstream ones in the sub scanning direction SD to form a plurality of spot latent images Lsp aligned in the main scanning direction MD.

In such a line head 29, the respective light emitting elements 2951 arranged at the positions mutually different in the width direction LTD form spots SP at positions mutually different in the sub scanning direction SD (FIG. 11). Due to such differences in spot formation positions in the sub scanning direction SD, various exposure failures occurred in some cases.

Figure 13:
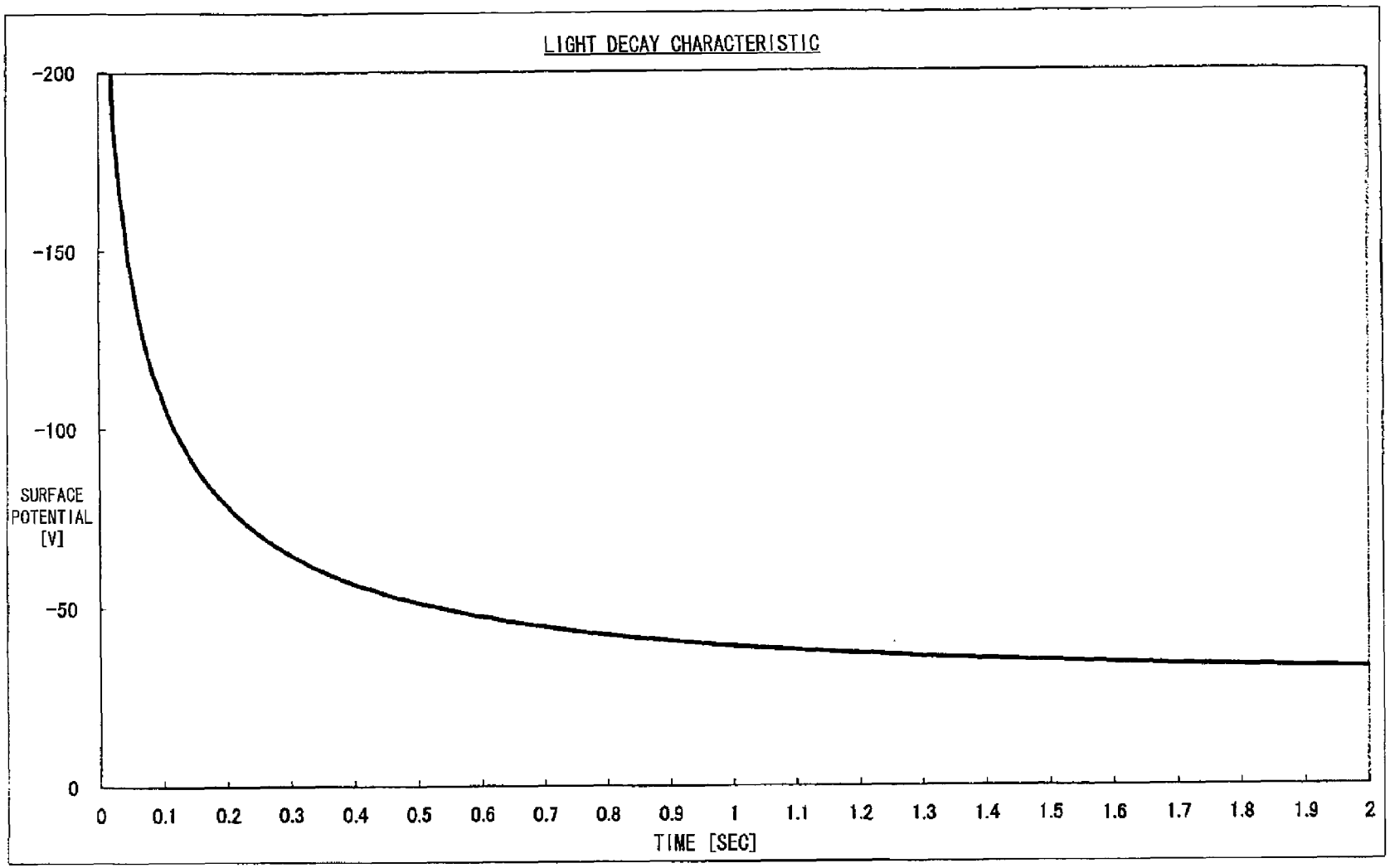
FIG. 13 is a graph showing the light decay characteristic of the photosensitive drum surface.

Specifically, spot latent images tend to enlarge with time, as shown in first and second embodiments for example, since the photosensitive drum surface has such a light decay characteristic as shown in FIG. 13. Accordingly, out of a plurality of spot latent images Lsp formed side by side in the sub scanning direction SD, those formed by the upstream spots SP in the sub scanning direction SD became larger than those formed by downstream spots SP in the sub scanning direction SD in some cases since the passage of time after formation was longer. As a result, there were cases where the sizes of the plurality of spot latent images Lsp formed side by side in the main scanning direction M varied.

Alternatively, as shown in a third embodiment, the photosensitive drum surface has a curvature shape in a sub-scanning direction section (sub-scanning section). Accordingly, distances (element-spot distances) between the light emitting elements 2951 and the spots SP formed by the light emitting elements 2951 may differ among the respective light emitting elements 2951 arranged at the mutually different positions in the width direction LTD. However, as described later, the spot latent images formed by these spots SP tend to enlarge in some cases as the element-spot distances increase. As a result, there were cases where the size varied among the plurality of spot latent images formed by the spots SP at the positions mutually different in the sub scanning direction SD.

In contrast, in the line heads 29 shown in the following embodiments, the light quantities of the light emitting elements 2951 are adjusted according to the positions of the spots SP formed by the light emitting elements 2951 in the sub scanning direction SD. Accordingly, a good exposure can be realized by suppressing the occurrence of an exposure failure resulting from differences in the formation positions of the spots SP in the sub scanning direction SD.

D-1. First Embodiment

FIG. 13 is a graph showing the light decay characteristic of the photosensitive drum surface, wherein a horizontal axis represents time [sec] and a vertical axis represents the potential [V] of the photosensitive drum surface. Here, the light decay characteristic is a characteristic indicating a change of the surface potential of the photosensitive drum with time. As shown in FIG. 13, the surface potential of the photosensitive drum charged to a specified negative potential at time 0 [sec] increases with time. In this way, the photosensitive drum surface cannot be maintained at a constant surface potential and the surface potential increases with time.

On the other hand, as described with reference to FIGS. 11 and 12, the spots SP are successively formed from the upstream ones in the sub scanning direction SD to form a plurality of spot latent images Lsp aligned in the main scanning direction MD. Accordingly, out of the plurality of spot latent images Lsp aligned in the main scanning direction MD, those formed by the upstream spots SP in the sub scanning direction SD are larger than those formed by the downstream spots SP in the sub scanning direction SD since the passage of time after formation is longer, wherefore the formed spot latent images varied in some cases.

Figure 14:
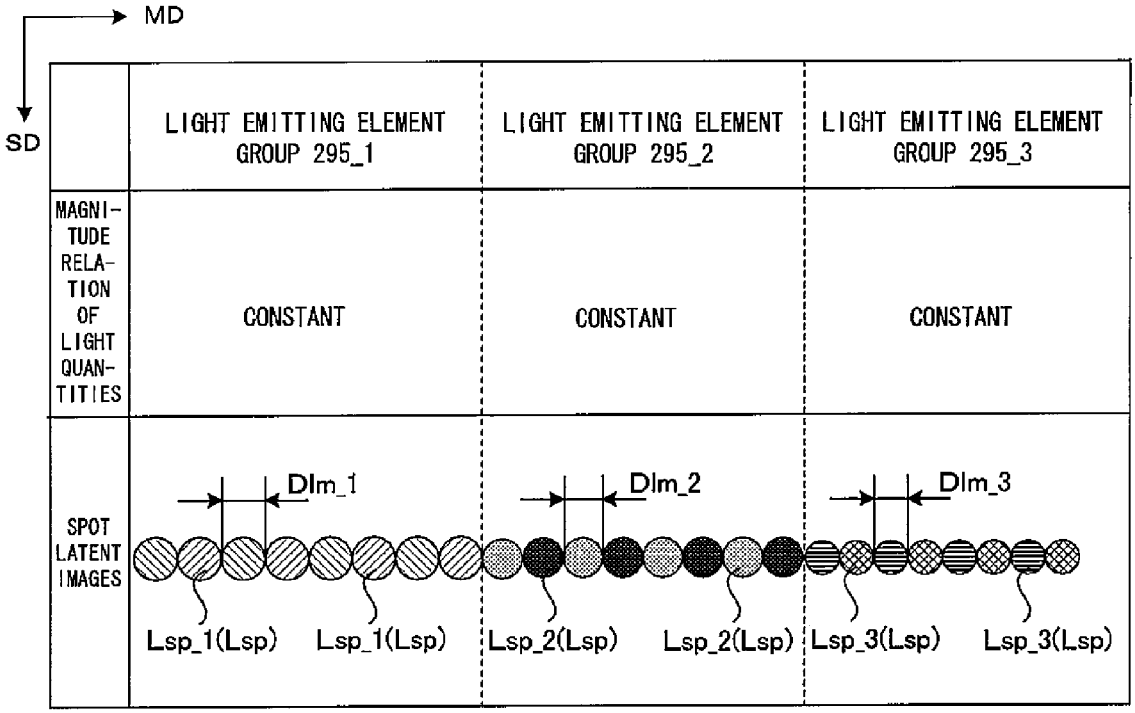
FIG. 14 is a diagrammatic table showing variations of spot latent images.

FIG. 14 is a diagrammatic table showing variations of spot latent images. In FIG. 14, the spot latent images formed by the respective light emitting elements 2951 of the light emitting element groups 295_1, 295_2 and 295_3 are diagrammatically shown. As can be understood from the above description, the light emitting elements 2951 of the light emitting element group 295_1 form the spots SP at a side more upstream in the sub scanning direction SD than those of the light emitting element groups 295_2 and 295_3. Further, the light emitting elements 2951 of the light emitting element group 295_2 form the spots SP at a side more upstream in the sub scanning direction SD than those of the light emitting element group 295_3. At this time, as shown in the row "Magnitude Relation of Light Quantities" of FIG. 14, when the light quantities of the respective light emitting elements 2951 are set constant regardless of the positions of the spots SP to be formed, spot latent images Lsp as shown in the row "Spot Latent Images" of FIG. 14 are formed side by side in the main scanning direction MD. Here, hatching patterns of the respective spot latent images Lsp means the same as those of FIG. 12.

Specifically, the spot latent images Lsp formed by the upstream spots SP in the sub scanning direction SD are larger than those formed by the downstream spots SP. More specifically, the spot latent images Lsp_1 formed by the light emitting elements 2951 of the light emitting element group 295_1 are larger than the spot latent images Lsp_2, Lsp_3 formed by the light emitting elements 2951 of the light emitting element groups 295_2, 295_3. Further, the spot latent images Lsp_2 formed by the light emitting elements 2951 of the light emitting element group 295_2 are larger than the spot latent images Lsp_3 formed by the light emitting elements 2951 of the light emitting element group 295_3. Particularly, in an embodiment shown in FIG. 14, the size relations of diameters Dlm_1, Dlm_2 and Dlm_3 of the spot latent images Lsp_1, Lsp_2 and Lsp_3 in the main scanning direction MD is:

$$Dlm_1 > Dlm_2 > Dlm_3.$$

Accordingly, in order to deal with such a problem, the light quantities of the light emitting elements 2951 are adjusted as follows in the first embodiment.

Figure 15:
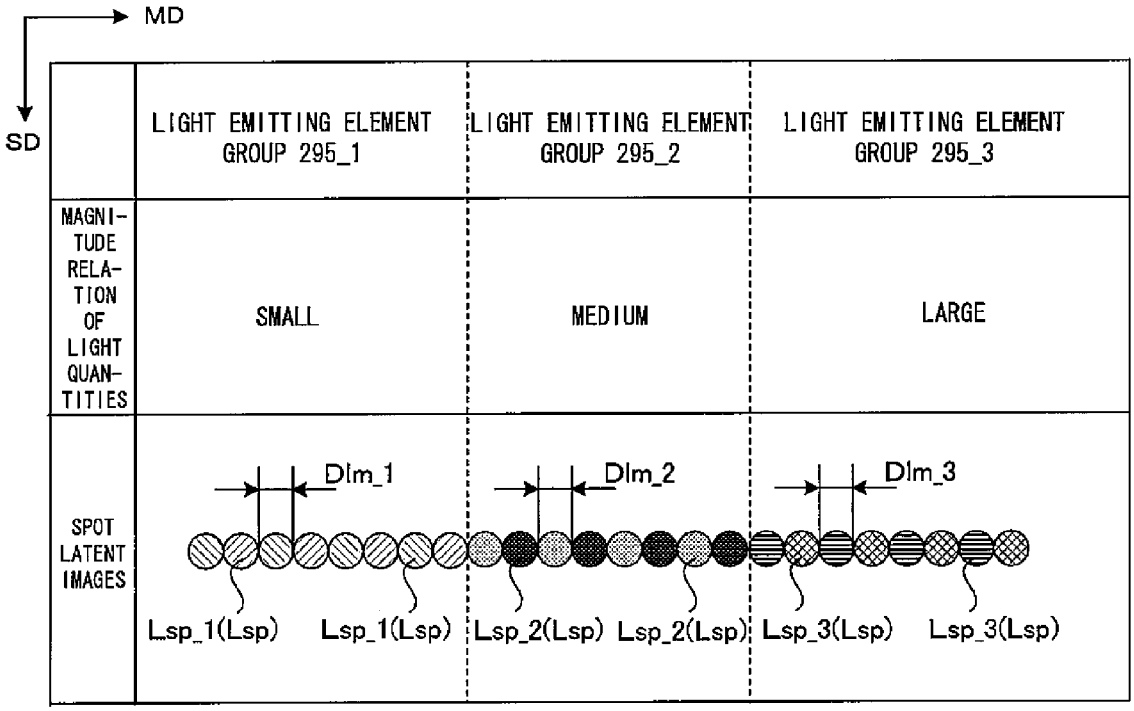
FIG. 15 is a diagrammatic table showing an exemplary adjusted state of the light quantities of the light emitting elements in the first embodiment.

FIG. 15 is a diagrammatic table showing an exemplary adjusted state of the light quantities of the light emitting elements in the first embodiment. As shown in FIG. 15, in the first embodiment, the light emitting elements 2951 of the light emitting element groups 295 for forming the spots SP at a more upstream side are set to have less (smaller) light quantities. Specifically, the light quantity of the light emitting elements 2951 of the light emitting element group 295_1 is adjusted to be smaller than those of the light emitting elements 2951 of the light emitting element groups 295_2, 295_3, and the light quantity of the light emitting elements 2951 of the light emitting element group 295_2 is adjusted to be smaller than that of the light emitting elements 2951 of the light emitting element group 295_3 (see the row "Magnitude Relation of Light Quantities"). As a result, as shown in the row "Spot Latent Images" of FIG. 15, the variation of the spot latent images Lsp_1, Lsp_2 and Lsp_3 is suppressed and that of the diameters Dlm_1, Dlm_2 and Dlm_3 of the spot latent images Lsp_1, Lsp_2 and Lsp_3 in the main scanning direction MD is also alleviated.

As described above, in the first embodiment, the light quantities of the light emitting elements 2951 are adjusted according to the positions of the spots SP formed by the light emitting elements 2951 in the sub scanning direction SD. Accordingly, a good exposure can be realized by suppressing the occurrence of an exposure failure resulting from differences in the formation positions of the spots SP in the sub scanning direction SD.

In the first embodiment, when the light emitting element for forming a spot at an upstream side in the sub scanning direction SD is called an upstream light emitting element and the one for forming a spot at a downstream side is called a downstream light emitting element out of two light emitting elements 2951 for forming spots SP at positions different in the sub scanning direction SD, the light quantity of the upstream light emitting element is adjusted to be smaller than that of the downstream light emitting element. Specifically, the light quantity of the light emitting elements 2951 (upstream light emitting elements) of the light emitting element group 295_1 is adjusted to be smaller than that of the light emitting elements 2951 (downstream light emitting elements) of the light emitting element group 295_2. Further, the light quantity of the light emitting elements 2951 (upstream light emitting elements) of the light emitting element group 295_2 is adjusted to be smaller than that of the light emitting elements 2951 (downstream light emitting elements) of the light emitting element group 295_3. Accordingly, the variation of the plurality of spot latent images Lsp formed side by side in the main scanning direction MD can be suppressed regardless of the enlargement of the spot latent images Lsp with time, wherefore a good exposure can be realized.

D-2. Second Embodiment

Figure 16:
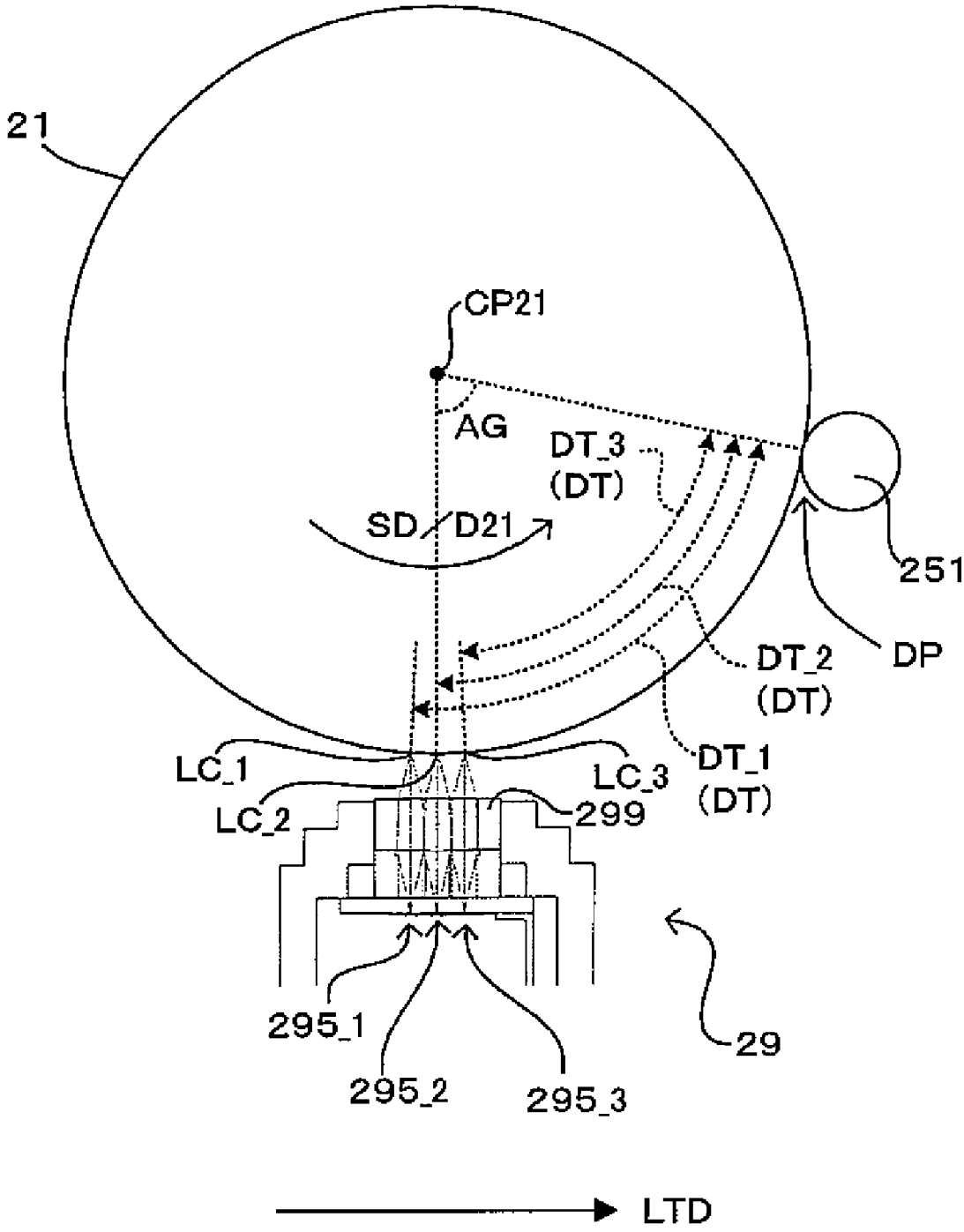
FIG. 16 is a diagram showing an image forming apparatus according to a second embodiment.

FIG. 16 is a diagram showing an image forming apparatus according to a second embodiment. The second embodiment is described below with reference to FIG. 16. In an image forming apparatus 1 including the above line head 29, when the line head 29 forms spots SP on the photosensitive drum surface charged by the charger 23, areas where the spots SP are formed are neutralized to form spot latent images Lsp. These spot latent images Lsp are developed with toner by the developer 25 at a development position DP. Here, the development position DP is a position where the spot latent images Lsp are developed with toner and corresponds to a position where the developing roller 251 and the photosensitive drum 21 are in contact in this embodiment.

On the other hand, when spot-development distances DT are distances in the sub scanning direction SD between the spots SP and the development position DP, the spot-development distances DT differ among the respective spots SP formed at positions different in the sub scanning direction SD by the above line head 29. Specifically, if a position LC_1 is the position of the spots SP formed by the light emitting elements 2951 of the light emitting element group 295_1 in the sub scanning direction SD, a position LC_2 is the position of the spots SP formed by the light emitting elements 2951 of the light emitting element group 295_2 in the sub scanning direction SD and a position LC_3 is the position of the spots SP formed by the light emitting elements 2951 of the light emitting element group 295_3 in the sub scanning direction SD, distances DT_1, DT_2 and DT_3 in the sub scanning direction SD between the positions LC_1, LC_2 and LC_3 and the development position DP differ from each other and has the following relationship (see FIG. 16).

$$DT_1>DT_2>DT_3$$

Accordingly, the potentials of the spot latent images Lsp formed by the upstream spots SP in the sub scanning direction SD and those of the spot latent images Lsp formed by the downstream spots SP differed at the development position DP in some cases.

A more specific simulation result is described. When potentials VT_1, VT_2 and VT_3 are the potentials of the respective spot latent images Lsp_1, Lsp_2 and Lsp_3 at the development position DP, the respective potentials varied as follows in some cases.

$$VT_1=-105.9\ [V]$$

$$VT_2=-102.4\ [V]$$

$$VT_3=-99.3\ [V]$$

Such a simulation was performed on the condition that a photosensitive drum diameter=40 [mm], a photosensitive member linear speed=212 mm/sec, an exposure-development angle AG=68 degrees and the row pitch Pegr of the light emitting element group rows=1.7 [mm]. The exposure-development angle AG is an angle (FIG. 16) formed by the intersection of a straight line extending from the rotary shaft CP21 of the photosensitive drum 21 to the spot formation position LC_2 of the light emitting element group 295_2 and a straight line extending from the rotary shaft CP21 to the development position DP. The photosensitive drum surface is assumed to have the light decay characteristic shown in FIG. 13.

Accordingly, the spot latent images Lsp formed by the upstream spots SP in the sub scanning direction SD may differ in size at the development position DP from those formed by the downstream spots SP, that is, the sizes or the like of the spot latent images Lsp may vary at the development position DP. Thus, in order to deal with such a problem, the light quantities of the light emitting elements 2951 are adjusted as follows in the second embodiment.

Figure 17:
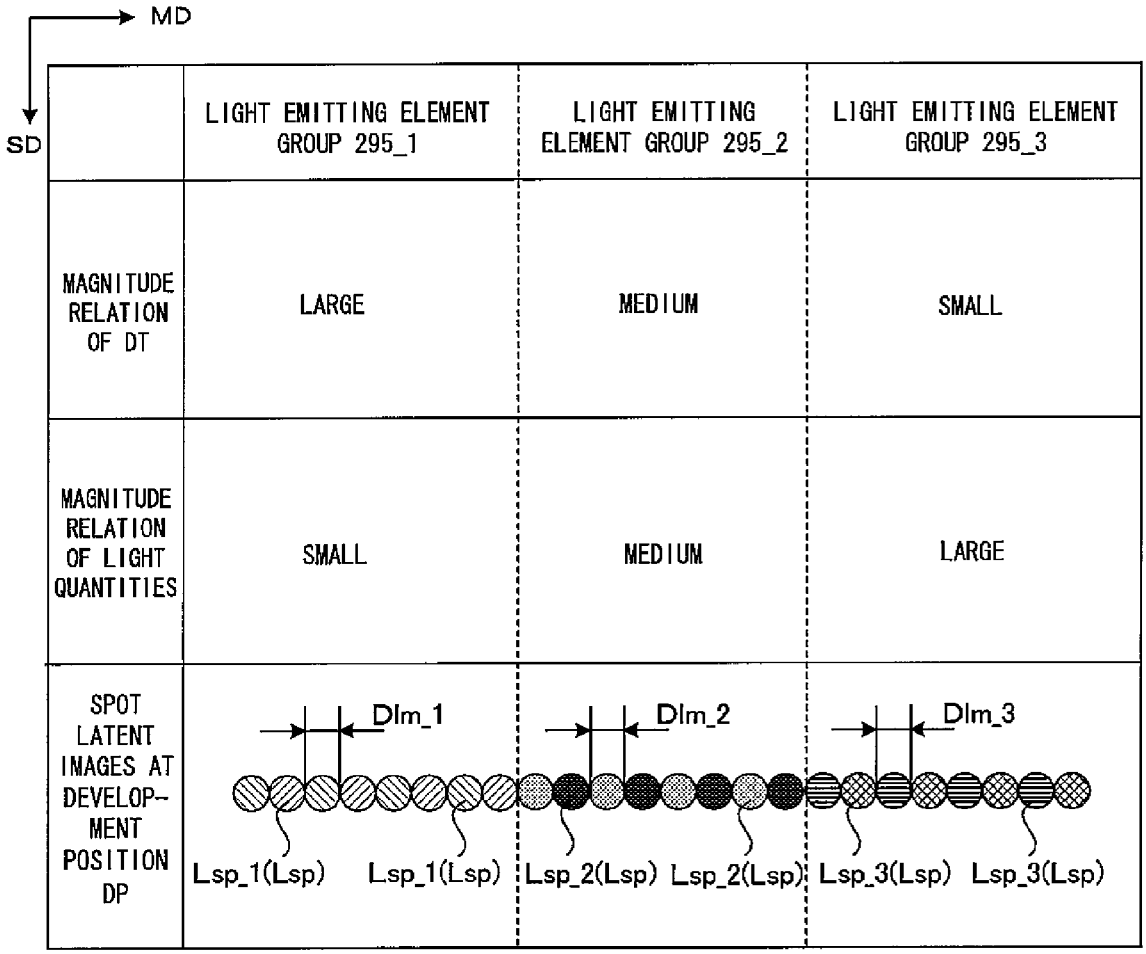
FIG. 17 is a diagrammatic table showing an exemplary adjusted state of the light quantities of the light emitting elements in the second embodiment.

FIG. 17 is a diagrammatic table showing an exemplary adjusted state of the light quantities of the light emitting elements in the second embodiment. As shown in FIG. 17, the light emitting elements 2951 of the light emitting element group having longer (larger) distance DT between the position LC_1, LC_2 or LC_3 of the spots SP and the development position DP are set to have less (smaller) light quantity. Specifically, the light quantity of the light emitting elements 2951 of the light emitting element group 295_1 is adjusted to be smaller than those of the light emitting elements 2951 of the light emitting element groups 295_2, 295_3, and the light quantity of the light emitting elements 2951 of the light emitting element group 295_2 is adjusted to be smaller than that of the light emitting elements 2951 of the light emitting element group 295_3 (see the row "Magnitude Relation of Light Quantities" of FIG. 17). As a result, as shown in the row "Spot Latent Images at Development Position DP" of FIG. 17, the variation of the spot latent images Lsp_1, Lsp_2 and Lsp_3 at the development position DP is suppressed and, for example, the variation of diameters Dlm_1, Dlm_2 and Dlm_3 of the spot latent images Lsp_1, Lsp_2 and Lsp_3 in the main scanning direction MD is also suppressed.

As described above, in the second embodiment as well, the light quantities of the light emitting elements 2951 are adjusted according to the positions of the spots SP formed by the light emitting elements 2951 in the sub scanning direction SD. Accordingly, a good exposure can be realized by suppressing the occurrence of an exposure failure resulting from differences in the formation positions of the spots SP in the sub scanning direction SD.

Further, in the second embodiment, the light quantities of the light emitting elements 2951 are adjusted according to the distances DT in the sub scanning direction SD between the spots SP formed by the light emitting elements 2951 and the development position DP. Accordingly, good image formation can be performed by suppressing the variation of the spot latent images Lsp at the development position DP.

D-3. Third Embodiment

Figure 18:
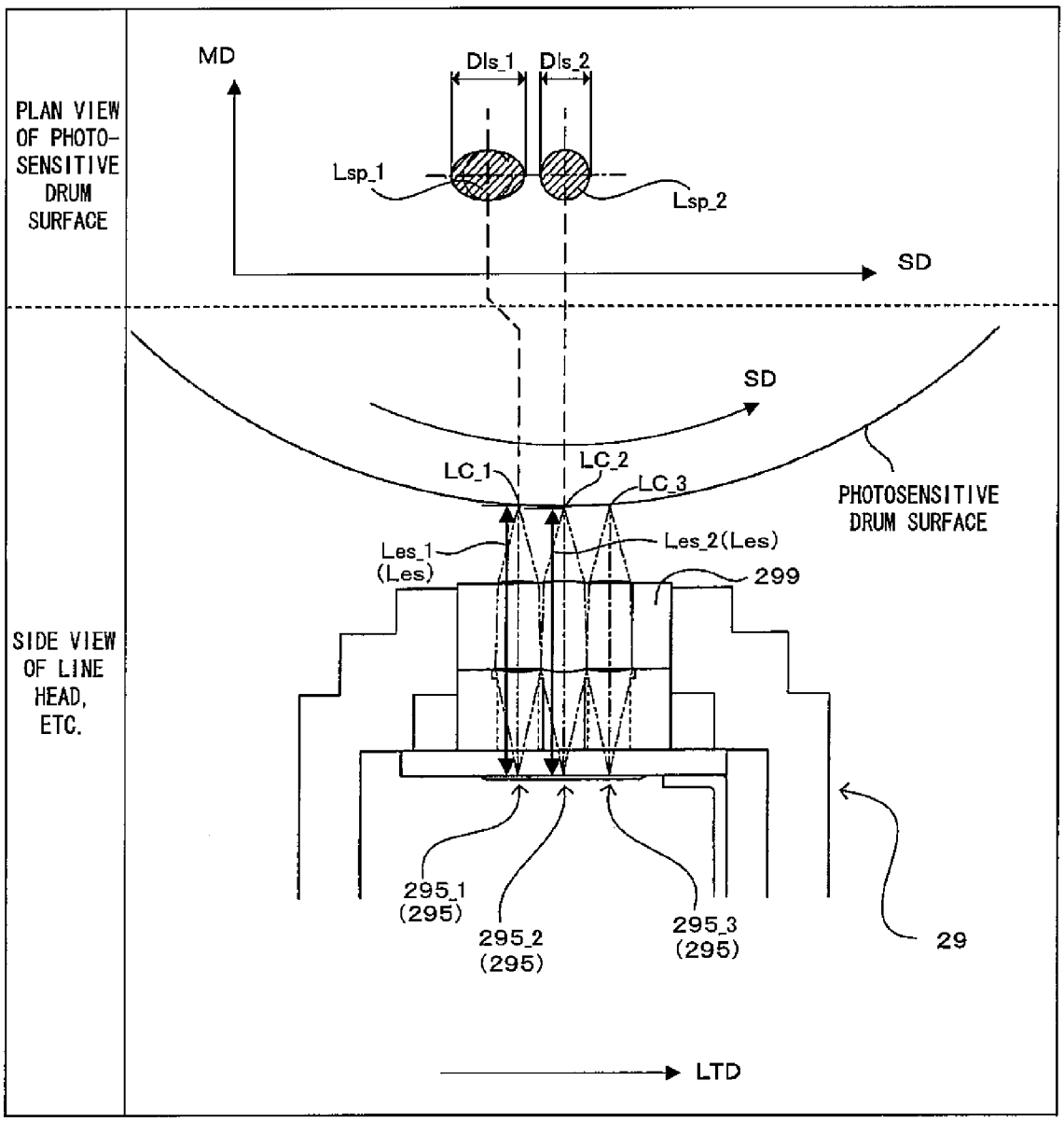
FIG. 18 is a diagram showing the variation of spot latent images.

The surface of the photosensitive drum 21 has a curvature shape in the section (sub-scanning section) in the sub scanning direction SD (FIG. 18 and other figures). In this specification, the shape of the outer circumferential surface of a cylindrical shape is defined to be a "curvature shape". In addition, as described above, the respective light emitting elements 2951 of the respective light emitting element groups 295 arranged at different positions in the width direction LTD in the line head 29 form spots SP at positions of the photosensitive drum surface mutually different in the sub scanning direction SD. Accordingly, the distances (element-spot distances Les) between the light emitting elements 2951 and the spots SP formed by the light emitting elements 2951 may differ among the respective light emitting element groups 295 arranged at the different positions in the width LTD. However, the spot latent images Lsp formed by these spots SP may tend to become larger as the element-spot distances Les increase. In other words, due to the curvature shape of the photosensitive drum surface, the imaged positions of the light beams may be shifted from the photosensitive drum surface, wherefore there are cases where the light beams of the light emitting elements 2951 with shorter element-spot distances Les are imaged on the photosensitive drum surface while those of the light emitting elements 2951 with longer element-spot distances Les are imaged at positions shifted from the photosensitive drum surface. In such cases, the spots SP that can be formed on the photosensitive drum surface by the light emitting elements 2951 with longer element-spot distances Les enlarge. As a result, the size varied among the plurality of spot latent images Lsp formed by the spots SP at the positions mutually different in the sub scanning direction SD in some cases.

FIG. 18 is a diagram showing the variation of spot latent images. As shown in the row "Side View of Line Head" of FIG. 18, the element-spot distances Les differ among the light emitting element groups 295. Specifically, when an element-spot distance Les_1 is a distance between the light emitting elements 2951 of the light emitting element group 295_1 and the spot formation position LC_1 of these light emitting elements 2951 and an element-spot distance Les_2 is a distance between the light emitting elements 2951 of the light emitting element group 295_2 and the spot formation position LC_2 of these light emitting elements 2951, the relationship of the respective element-spot distances Les_1, Les_2 is as follows.

$$Les_1 > Les_2$$

As a result, the spot latent images Lsp_1 formed by the light emitting elements 2951 of the light emitting element group 295_1 are larger than the spot latent images Lsp_2 formed by the light emitting elements 2951 of the light emitting element group 295_2 (see the row "Plan View of Photosensitive Drum Surface" of FIG. 18). Particularly in an embodiment of FIG. 18, a diameter Dls_1 of the spot latent images Lsp_1 in the sub scanning direction SD is larger than a diameter Dls_2 of the spot latent images Lsp_2 in the sub scanning direction SD.

In the third embodiment, a distance between the light emitting elements 2951 of the light emitting element group 295_3 and the spot formation position LC_3 of these light emitting elements 2951 is substantially equal to the element-spot distance Les_1 corresponding to the light emitting element group 295_1. In order to deal with such a variation of the spot latent images, the light quantities of the light emitting elements 2951 are adjusted as follows in the third embodiment.

Figure 19:
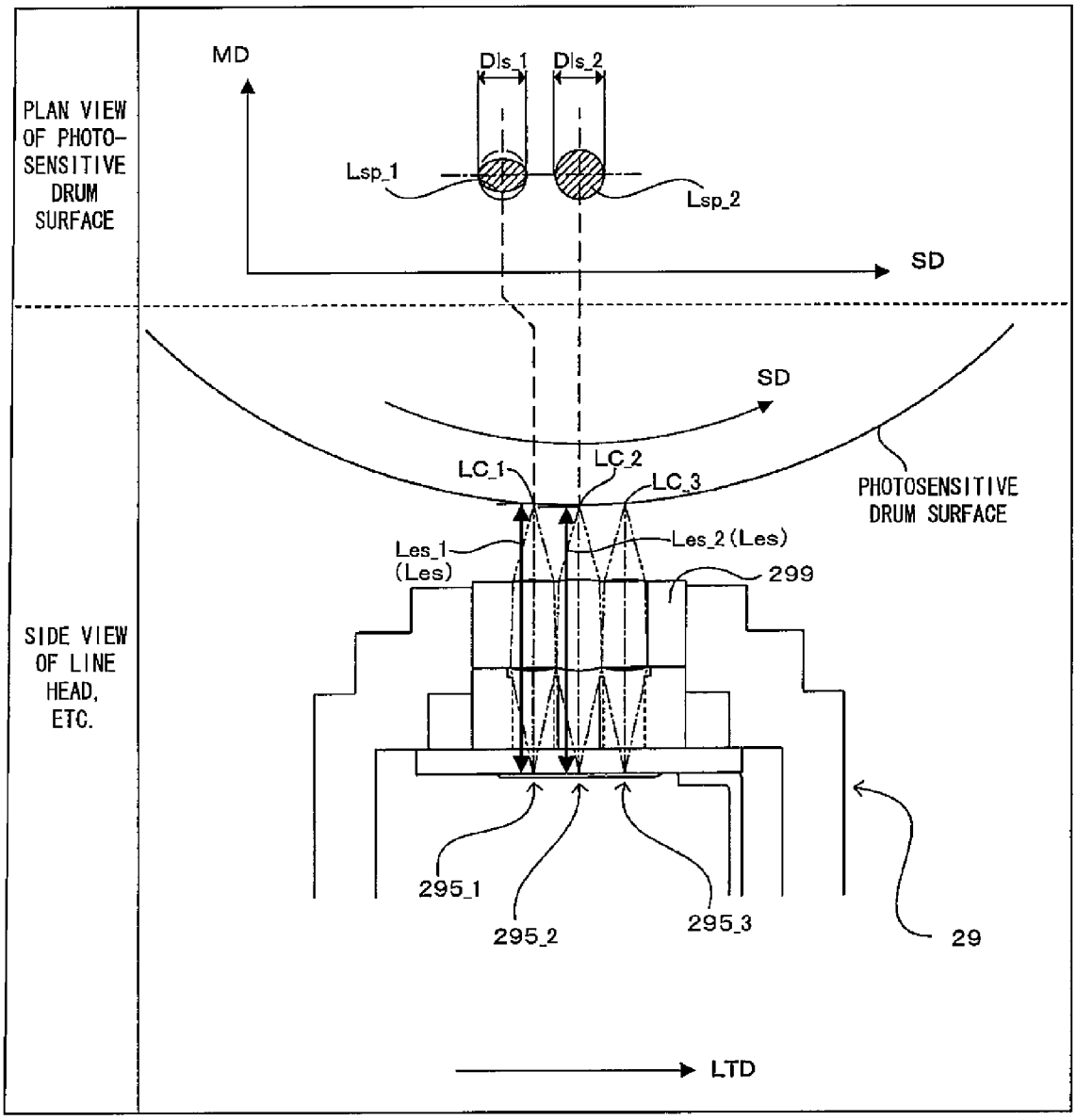
FIG. 19 is a diagram showing an exemplary adjusted state of the light quantities of the light emitting elements in the third embodiment.

FIG. 19 is a diagram showing an exemplary adjusted state of the light quantities of the light emitting elements in the third embodiment. In the third embodiment, the light emitting elements of the light emitting element groups 295 having longer element-spot distances Les are set to have less (smaller) light quantities. Specifically, the light quantity of the light emitting elements 2951 of the light emitting element group 295__1 (295_3) is adjusted to be smaller than that of the light emitting elements 2951 of the light emitting element group 295_2. As a result, as shown in the row "Plan View of Photosensitive Drum Surface" of FIG. 19, the diameter Dls_1 of the spot latent images Lsp_1 in the sub scanning direction SD and the diameter Dls_2 of the spot latent images Lsp_2 in the sub scanning direction SD are substantially equal and the variation of the spot latent images as shown in FIG. 18 is suppressed.

As described above, in the third embodiment, the light quantities of the light emitting elements 2951 are adjusted according to the positions of the spots SP formed by these light emitting elements 2951 in the sub scanning direction SD. Accordingly, a good exposure can be realized by suppressing the occurrence of an exposure failure resulting from differences in the spot formation positions in the sub scanning direction SD.

Particularly in the third embodiment, out of two light emitting elements 2951 adapted to form spots SP at positions mutually different in the sub scanning direction SD and having mutually different element-spot distances Les, the light quantity of the light emitting element 2951 having a longer element-spot distance Les is adjusted to be smaller than that of the light emitting element 2951 having a shorter element-spot distance Les. More specifically, the light quantity of the light emitting elements 2951 of the light emitting element group 295_1 are adjusted to be smaller than that of the light emitting elements 2951 of the light emitting element group 295_2. Accordingly, a good exposure can be realized by suppressing the size variation of the spot latent images Lsp regardless of the element-spot distances Les.

D-4. Fourth Embodiment

In this embodiment, after a spot variation produced due to a shift of the line head 29 relative to the photosensitive drum 21 in the width direction LTD is described, technology for suppressing the influence of this spot variation on latent image formation is described.

Figure 20:
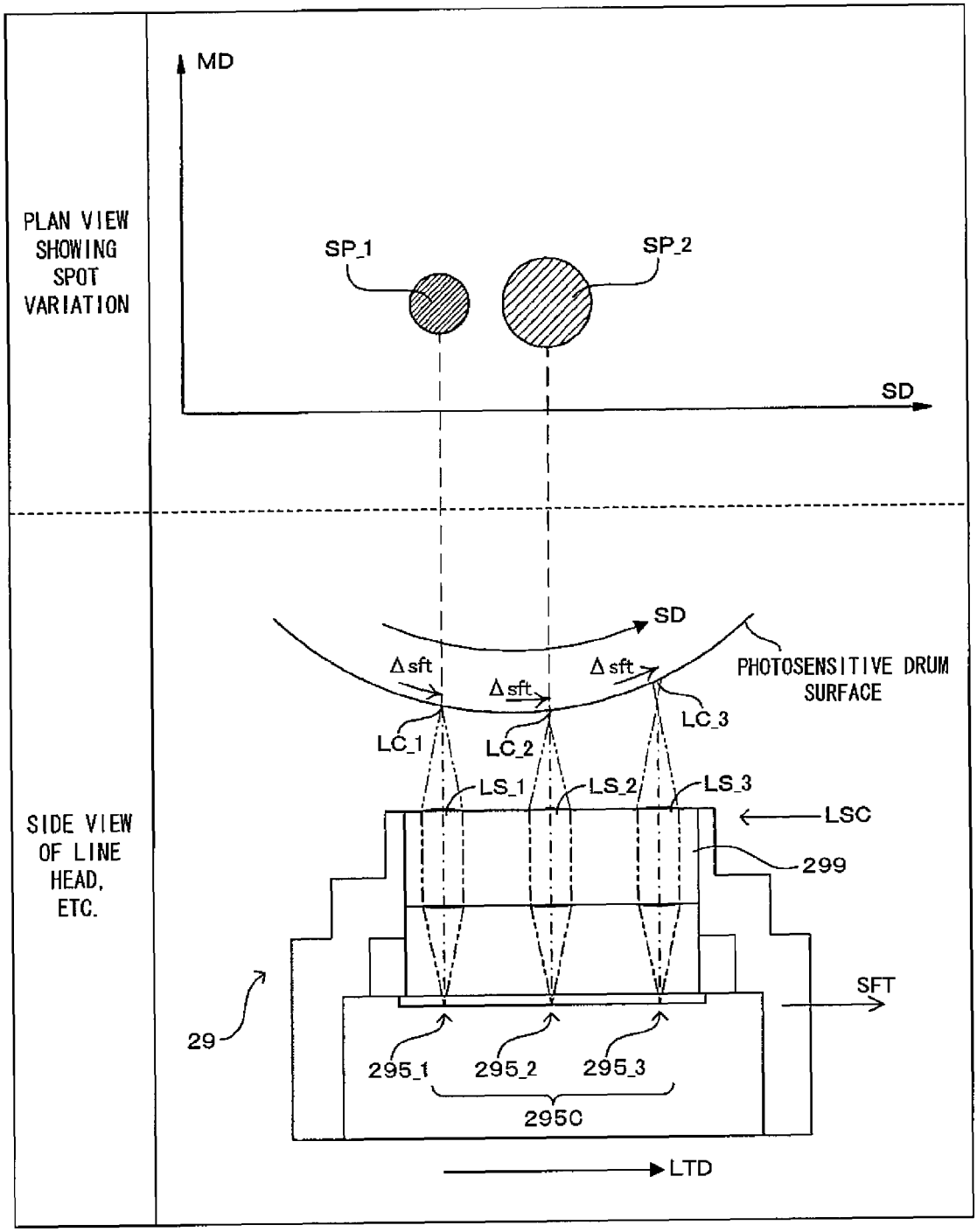
FIG. 20 is a diagram showing a spot variation in the case of a shift of the line head relative to the photosensitive drum in the width direction.

FIG. 20 is a diagram showing a spot variation in the case of a shift of the line head relative to the photosensitive drum in the width direction. Three light emitting element groups 295_1 to 295_3 shown in the row "Side View of Line Head, Etc." of FIG. 20 constitute the same light emitting element group column 295C, and three lenses LS_1 to LS_3 constitute the same lens column LSC. Lights emitted from the respective light emitting element groups 295_1 to 295_3 are imaged by the corresponding ones of the lenses LS_1 to LS_3 to form spots on the surface of the photosensitive drum 21.

In FIG. 20, spot formation positions LC_1 to LC_3 of the respective lenses LS_1 to LS_3 are shifted in the sub scanning direction SD by a shift amount Δsft by the shift of the line head 29 in the width direction LTD. On the other hand, since the surface of the photosensitive drum 21 has a curvature shape, distances between the spot formation positions LC_1, . . . and the lenses LS_1, . . . vary if the spot formation positions LC_1 to LC_3 are shifted in the sub scanning direction SD by the shift amount Δsft. Specifically, a distance between the lens LS_1 and the spot formation position LC_1 becomes shorter, whereas a distance between the lens LS_2 and the spot formation position LC_2 becomes longer. As a result, some of the spots SP enlarged in some cases. In an embodiment shown in FIG. 20, spots SP_1 formed by the lens LS_1 do not enlarge very much, but spots SP_2 formed by the lens LS_2 enlarge (see the row "Plan View Showing Spot Variation" of FIG. 20). Thus, light quantity density (light quantity per unit area) decreases in the spots SP_2, wherefore spot latent images could not be stably formed by the spots SP_2 in some cases. As a result, there was a possibility of producing the size variation and the like of latent images formed by the spots SP_1 and the spots SP_2.

Specifically, the spots SP may enlarge depending on their formation positions (spot formation positions), with the result that good latent image formation could not be performed in some cases. Accordingly, in order to deal with such a problem, the light quantities of the light emitting elements for forming the spots at the spot formation positions LC_1, . . . may be adjusted according to the spot formation positions LC_1, . . . (from another perspective, according to the positions of the lenses in the width direction LTD). Specifically, the light quantity of the light emitting elements for forming the spots SP_2 may be set larger than that of the light emitting elements for forming the spots SP_1. In this way, any of the spots SP_1 and the spots SP_2 can form a uniform latent image.

As described above, in this embodiment, the line head 29 (exposure head) includes the lens LS_1 (first imaging optical system) and the lens LS_2 (second imaging optical system) distanced from the lens LS_1 in the width direction LTD. The light quantities of the light emitting elements are adjusted according to the lenses for imaging the lights of the light emitting elements. Accordingly, a good exposure can be realized and good image formation can be performed. The light quantity adjustment of the light emitting elements may be performed by the driving circuits DC_A, etc. (controller) provided on the head substrate 293 shown in FIG. 9 or by the head controller HC (controller) shown in FIG. 4.

E. Miscellaneous

As described above, in the above embodiments, the line head 29 corresponds to an "exposure head" of the invention, the photosensitive drum 21 to a "latent image carrier" of the invention, the sub scanning direction SD and the width direction LTD to a "first direction" of the invention, the lens LS to an "imaging optical system" of the invention and the head substrate 293 to a "substrate" of the invention. The surface of the photosensitive drum 21 corresponds to a "surface to be exposed" of the invention. When the lens LS for imaging the lights from the light emitting element group 295_1 is a "first imaging optical system" of the invention, the lenses LS for imaging the lights from the light emitting element groups 295_2, 295_3 correspond to a "second imaging optical system" of the invention. When the lens LS for imaging the lights from the light emitting element group 295_2 is the "first imaging optical system" of the invention, the lens LS for imaging the lights from the light emitting element group 295_3 corresponds to the "second imaging optical system" of the invention. The spot SP corresponds to a "light imaged by the imaging optical system" of the invention. In the first embodiment, the light emitting element of the light emitting element group 295_1 corresponds to a "light emitting element that emits a light to be imaged at a first position of the latent image carrier by the first imaging optical system" of the invention, and the light emitting element of the light emitting element group 295_2 corresponds to a "light emitting element that emits a light to be imaged at a second position more distant from a charger than the first position by the second imaging optical system" of the invention. In the third embodiment, the diameter of the light (spot SP) imaged on the photosensitive drum 21 by the lens LS in the sub scanning direction SD corresponds to an "imaging characteristic of the imaging optical system" of the invention. In the fourth embodiment, the position of the light (spot SP) imaged on the photosensitive drum 21 by the lens LS corresponds to the "imaging characteristic of the imaging optical system" of the invention. In the second embodiment, the distances between the positions LC_1, etc. of the lights imaged on the photosensitive drum 21 by the lenses LS and the development position DP correspond to the "imaging characteristic of the imaging optical system" of the invention.

The invention is not limited to the above embodiments and various changes other than the above can be made without departing from the gist thereof. Three light emitting element group rows 295R are arranged in the width direction LTD in the above embodiments. However, the number of the light emitting element group rows 295R is not limited to three and may be two.

Further, in the above embodiments, the light emitting element group 295 is made up of two light emitting element rows 2951R. However, the number of the light emitting element row 2951R constituting the light emitting element group 295 is not limited to two and may be one.

Further, in the above embodiments, the light emitting element row 2951R is made up of four light emitting elements 2951. However, the number of the light emitting elements 2951 constituting the light emitting element row 2951R is not limited to four.

In the above embodiments, organic EL devices are used as the light emitting elements 2951. However, the devices other than the organic EL devices may be used as the light emitting elements 2951. For example, LEDs (light emitting diodes) may be used as the light emitting elements 2951.

In the above embodiments, toner development is performed by the contact developing method by which the developing roller 251 is held in contact with the photosensitive drum surface. However, the toner developing method is not limited to this and toner development may be performed by a noncontact developing method by which a developing roller is distanced from a photosensitive drum surface and toner is caused to jump from the developing roller to the photosensitive drum surface.

Although the technology for adjusting the light quantities of the imaged lights for each lens row LSR is described in the first and the second embodiments and the like, the light quantities of the imaged lights by the lenses belonging to the same lens row LSR are not particularly mentioned. However, in the case where the line head 29 is warped in the longitudinal direction LGD (main scanning direction MD), the imaged light quantities may be adjusted among the lenses belonging to the same lens row LSR as described next.

Figure 21:
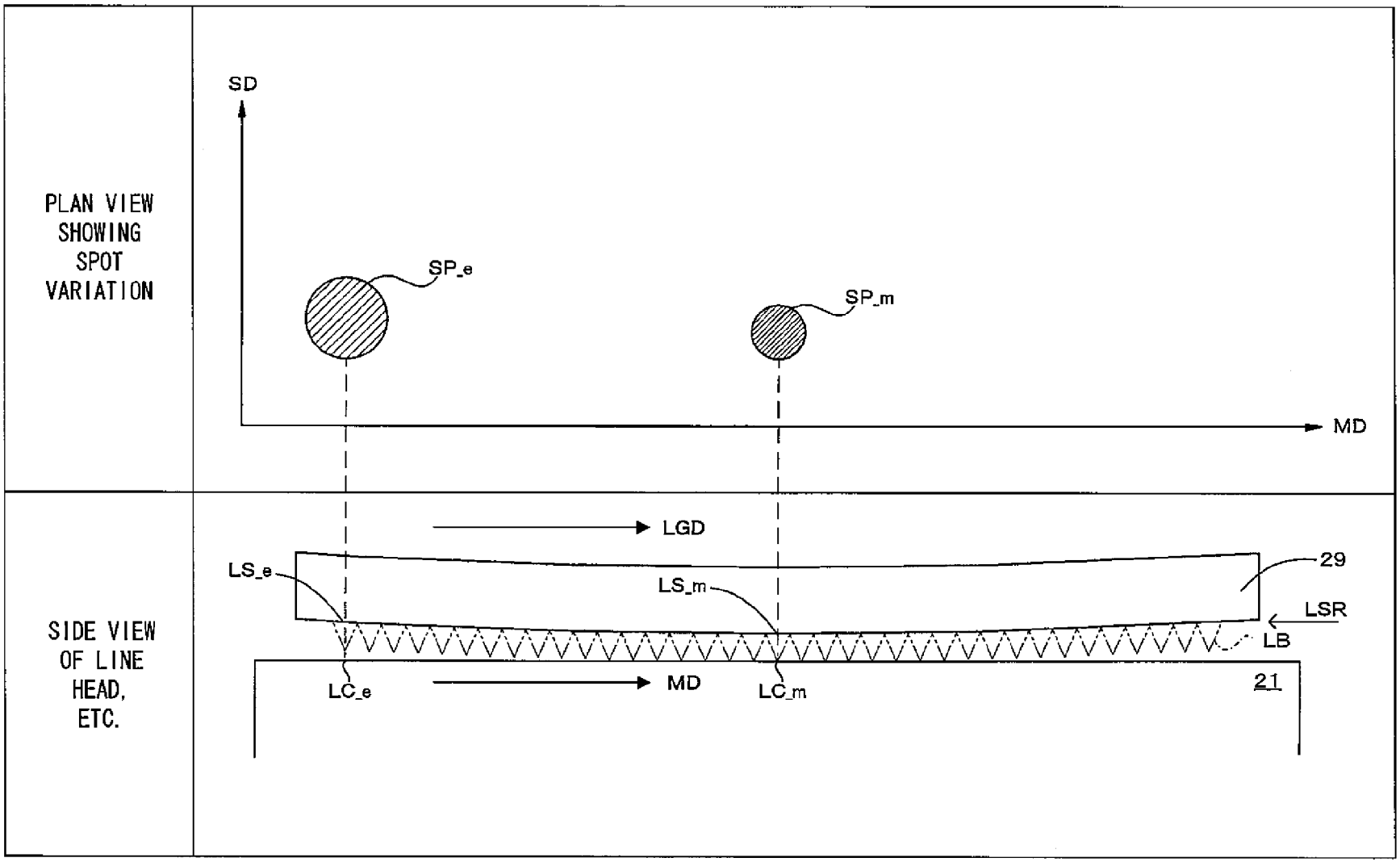
FIG. 21 is a diagram showing a spot variation when the line head is warped in the longitudinal direction.

FIG. 21 is a diagram showing a spot variation when the line head is warped in the longitudinal direction. In the row "Side View of Line Head, Etc." of FIG. 21, light beams LB imaged by the respective lenses of one lens row LSR are shown by dashed-dotted line. An end lens LS_e at an end of the lens row LSR in the longitudinal direction LGD and a middle lens LS_m in the middle of the lens row LSR in the longitudinal direction LGD (second direction) belong to the same lens row LSR.

In FIG. 21, the line head 29 is so warped in the longitudinal direction LGD as to be convex toward the surface of the photosensitive drum 21. As a result, distances between the spot formation positions and the lenses differ depending on the lenses. Specifically, a distance between the end lens LS_e and a spot formation position LC_e is longer than a distance between the middle lens LS_m and a spot formation position LC_m. As a result, the spots became larger from the middle part toward the ends in some cases. Specifically, a spot SP_e formed by the end lens LS_e is larger than a spot SP_m formed by the middle lens LS_m. Thus, the closer to the ends the spots are located, the lower the light quantity density is. There were, hence, cases where spot latent images could not be stably formed. Accordingly, in order to deal with such a problem, the light quantities of the corresponding light emitting elements 2951 may be increased for the lenses LS closer to the ends. In this way, uniform latent image formation is possible.

In the line head 29 of the above embodiments, the plurality of light emitting elements 2951 are grouped into the light emitting element groups 295 and the lenses LS are provided in a one-to-one correspondence with the light emitting element groups 295. However, the configuration of the line head 29 is not limited to this and may be configured, for example, as follows.

Figure 22:
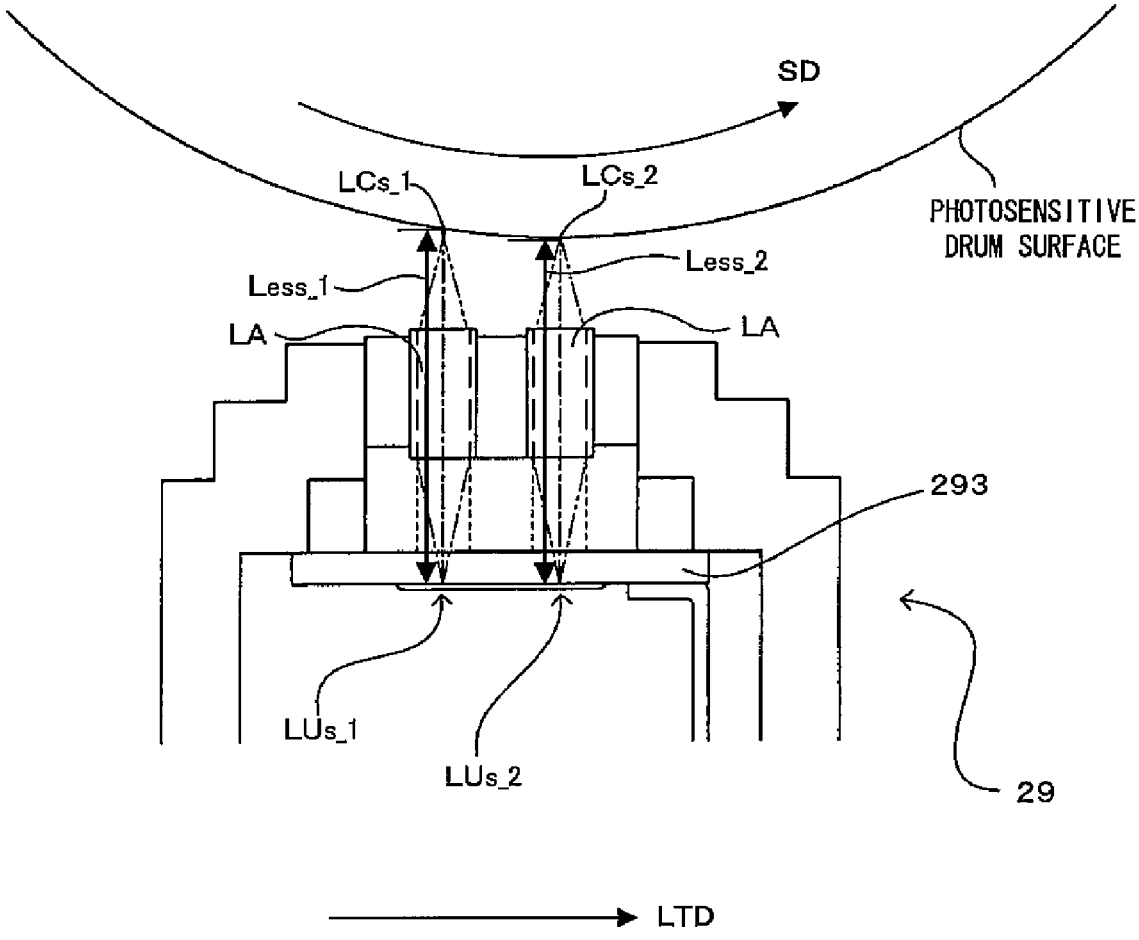
FIG. 22 is a width-direction sectional view showing another configuration of the line head.
Figure 23:
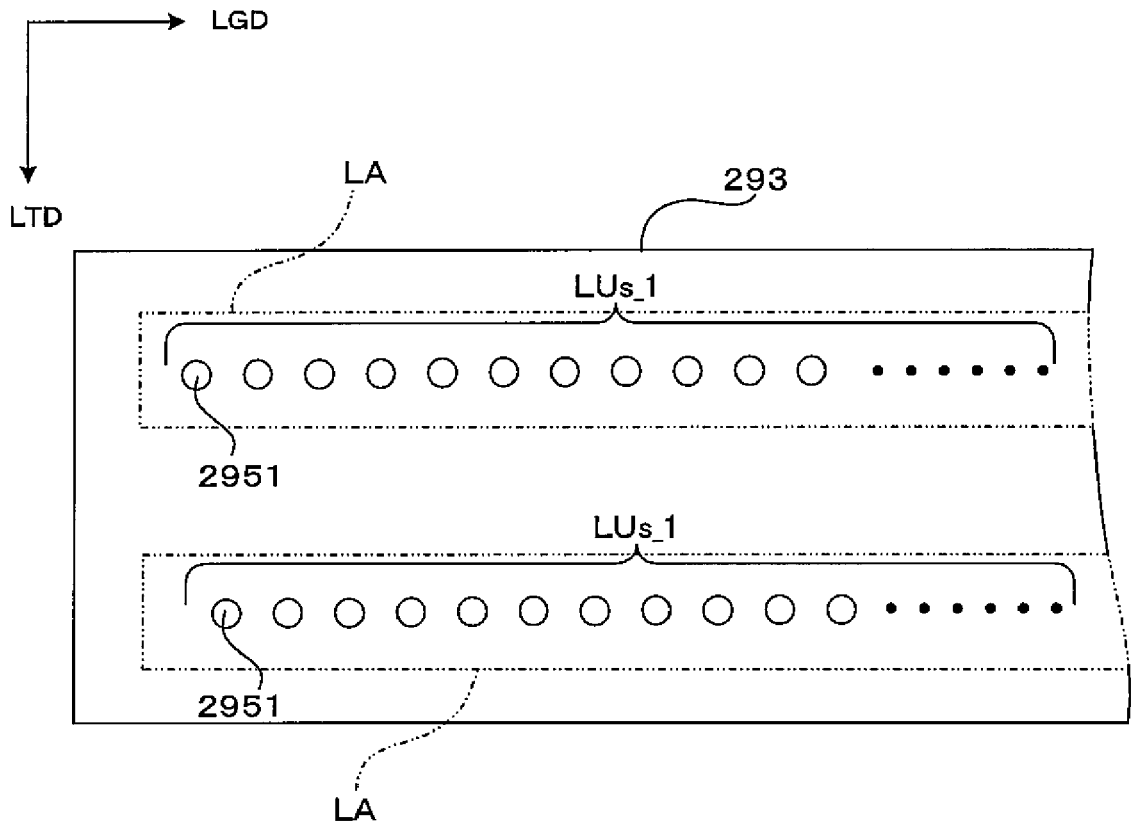
FIG. 23 is a plan view showing the under surface of a head substrate of the line head of FIG. 22.

FIG. 22 is a width-direction sectional view showing another configuration of the line head, and FIG. 23 is a plan view showing the under surface of a head substrate of the line head of FIG. 22. In FIG. 23, lens arrays LA are shown by chain double-dashed line. This is to show an arrangement relationship of the lens arrays LA and the light emitting elements, but not to show the arrangement of the lens arrays LA on the head substrate under surface. In the following description, points of difference from the line head described above are mainly described and common parts are not described by being identified by equivalent reference numerals.

As shown in FIG. 23, two rows of light emitting element lineups LUs_1, LUs_2 are arranged in the width direction LTD on the under side of the head substrate 293. In each light emitting element lineup LU, a plurality of light emitting elements 2951 are aligned in the longitudinal direction LGD. Further, the respective light emitting element lineups LUs_1, LUs_2 are displaced from each other in the longitudinal direction LGD so that the positions of the respective light emitting elements 2951 differ in the longitudinal direction LGD. Furthermore, two lens arrays LA are arranged to face the light emitting element lineups LUs_1, LUs_2 in a one-to-one correspondence (FIGS. 22, 23). Each lens array LA is formed by piling up a plurality of gradient index lenses in an offset manner and has an optical characteristic of erecting equal magnification.

In this way, the light emitting elements 2951 of the light emitting element lineup LUs_1 and those of the light emitting element lineup LUs_2 are arranged at positions mutually different in the width direction LTD. The respective light emitting element lineups LUs_1, LUs_2 form spots SP at positions LCs_1, LCs_2 mutually different in the sub scanning direction SD. Accordingly, the respective light emitting element lineups LUs_1, LUs_2 arranged at the mutually different positions in the width direction LTD are driven for light emission at timings in conformity with the movement of the photosensitive drum surface to form a plurality of spot latent images side by side in the main scanning direction MD.

Figure 24:
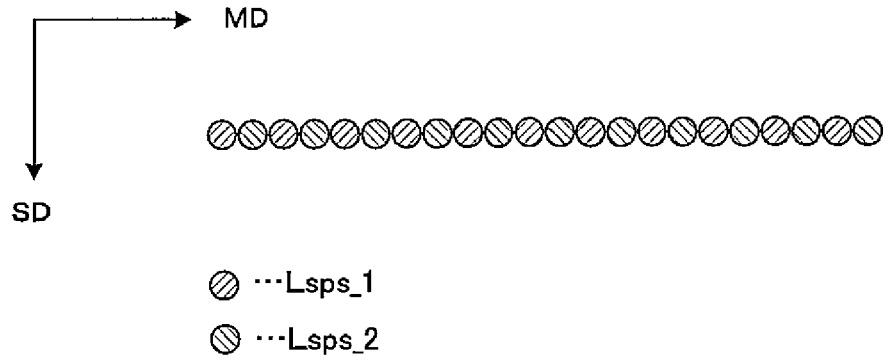
FIG. 24 is a diagram showing a spot latent image forming operation performed by the line head shown in FIG. 22.

FIG. 24 is a diagram showing a spot latent image forming operation performed by the line head shown in FIG. 22. In FIG. 24, spot latent images Lsps_1 are spot latent images formed by the light emitting elements 2951 of the light emitting element lineup LUs_1 and spot latent images Lsps_2 are spot latent images formed by the light emitting elements 2951 of the light emitting element lineup LUs_2. In other words, in the line head 29 according to the other configuration, the light emitting element lineup LUs_1 more upstream in the width direction LTD are first driven for light emission to form the spot latent images Lsps_1. Subsequently, the light emitting element lineup LUs_2 more downstream in the width direction LTD are driven for light emission to form the spot latent images Lsps_2. In this way, a plurality of spot latent images aligned in the main scanning direction MD are formed (FIG. 24).

As described above, also in the line head 29 shown in FIG. 22, the spots SP are successively formed from the upstream spots SP in the sub scanning direction SD to form a plurality of spot latent images Lsp aligned in the main scanning direction MD. Accordingly, similar to the one shown in the first embodiment and the like, there were cases where formed spot latent images varied. Thus, it is preferable to adjust the light quantities of the light emitting elements 2951 according to the positions of the spots SP formed by the light emitting elements 2951 in the sub scanning direction SD by applying the invention also to the line head 29 shown in FIG. 22. This is because a good exposure can be realized by suppressing the occurrence of the variation of the spot latent images.

As can be understood from FIG. 22, the surface of the photosensitive drum 21 has a curvature shape in a section in the sub scanning direction SD (sub-scanning section). Further, as described above, the respective light emitting elements 2951 of the respective light emitting element lineups LUs_1, LUs_2 arranged at the different positions in the width direction LTD form the spots SP at the positions LCs_1, LCs_2 of the photosensitive drum surface mutually different in the sub scanning direction SD. Accordingly, distances (element-spot distances Less_1, Less_2) between the light emitting elements 2951 and the spots SP formed by the light emitting elements 2951 may differ between the respective light emitting element lineups LUs_1, LUs_2 in some cases. Thus, similar to the one shown in the third embodiment, there were cases where the size varied among a plurality of spot latent images formed by the spots SP at the positions mutually different in the sub scanning direction SD.

Accordingly, it is preferable to adjust the light quantities of the light emitting elements 2951 according to the positions of the spots SP formed by the light emitting elements 2951 in the sub scanning direction SD by applying the invention also to the line head 29 shown in FIG. 22. This is because a good exposure can be realized by suppressing the occurrence of the variation of the spot latent images.

An embodiment of an image forming apparatus according to an aspect of the invention comprises: a latent image carrier that moves in a first direction; an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system; and a controller that is adapted to control a light quantity of the light emitting element that emits a light to be imaged on the latent image carrier by the first imaging optical system in accordance with an imaging characteristic of the first imaging optical system.

An embodiment of an exposure head according to an aspect of the invention comprises: a first imaging optical system; a second imaging optical system that is distanced from the first imaging optical system in a first direction in which a surface-to-be-exposed is moved; a light emitting element that emits a light to be imaged by the first imaging optical system; a light emitting element that emits a light to be imaged by the second imaging optical system; and a controller that is adapted to control a light quantity of the light emitting element that emits the light to be imaged by the first imaging optical system in accordance with an imaging characteristic of the first imaging optical system.

In the embodiment (exposure head, image forming apparatus) thus constructed, a first imaging optical system and a second imaging optical system are provided and the respective imaging optical systems image lights on a latent image carrier moving in a first direction. Further, the second imaging optical system is distanced from the first imaging optical system in the first direction. Accordingly, the position of the imaged light by the first imaging optical system and that of the imaged light by the second imaging optical system differ in the first direction and there is a likelihood of an exposure failure since the first imaging optical system is not capable of exposure similar to the second imaging optical system due to such a difference in the positions of the imaged light. In contrast, in the invention, a controller is provided for controlling a light quantity of the light emitting element for emitting a light to be imaged by the first imaging optical system according to an imaging characteristic of the first imaging optical system. Hence, a good exposure can be realized.

At this time, the imaging characteristic may be an area of the light imaged on the latent image carrier by the first imaging optical system. Alternatively, it may be a diameter of the light imaged on the latent image carrier by the first imaging optical system in the first direction. By adjusting the light quantity of the light emitting element according to such an imaging characteristic, a good exposure can be performed.

Further, the latent image carrier may be a photosensitive drum. Such a photosensitive drum has a curvature shape. As a result, there were cases where an exposure failure occurred because the imaged positions of the lights differed depending on the imaging optical systems. Accordingly, it is preferable to apply the invention to an apparatus provided with a photosensitive drum.

The imaging characteristic may also be a position of the light imaged on the latent image carrier by the first imaging optical system. A good exposure can be made by adjusting the light quantity of the light emitting element according to such an imaging characteristic.

A charger for charging the latent image carrier may be provided and the exposure head may expose the latent image carrier charged by the charger to form a latent image. Further, the first imaging optical system may image the light from the light emitting element on the latent image carrier at a first position, and the second imaging optical system may image the light from the light emitting element on the latent image carrier at a second position which is more distant from the charger than the first position. As described above, the thus formed latent image tends to enlarge with time. Accordingly, the controller may set the light quantity of the light emitting element for emitting the light to be imaged by the first imaging optical system smaller than that of the light emitting element for emitting the light to be imaged by the second imaging optical system. This is because a good exposure can be realized regardless of the enlargement of the spot latent images with time.

A developer for developing the latent image formed on the latent image carrier by the exposure head may be provided. As described above, in such a construction, an image formation failure occurred in some cases since the distances between the imaged light and a development position differed depending on the imaging optical systems. Accordingly, the light quantity of the light emitting element may be adjusted using a distance, as the imaging characteristic, between a position of the light imaged on the latent image carrier by the first imaging optical system and a development position at which the latent image formed by the light is developed by the developer. This is because an image formation failure resulting from the difference of the distances between the imaged light and the development position depending on the imaging optical systems can be suppressed.

A substrate may be provided on which the light emitting element for emitting the light to be imaged on the latent image carrier by the first imaging optical system and that for emitting the light to be imaged on the latent image carrier by the second imaging optical system are arranged. The controller may also be provided on the substrate. At this time, the controller can be constructed by a TFT.

A light shielding member arranged between the substrate and the imaging optical systems may be provided and may be provided with a first light guide hole arranged between the light emitting element for emitting the light to be imaged by the first imaging optical system and the first imaging optical system and a second light guide hole arranged between the light emitting element for emitting the light to be imaged by the second imaging optical system and the second imaging optical system.

The light emitting element for emitting the light to be imaged on the latent image carrier by the first imaging optical system and the light emitting element for emitting the light to be imaged on the latent image carrier by the second imaging optical system may be organic EL devices. At this time, the organic EL device may be of the bottom emission-type.

Further, an embodiment of an image forming apparatus according to another aspect of the invention comprises a latent image carrier moving in a first direction, an exposure head including an imaging optical system and a light emitting element for emitting a light to be imaged on the latent image carrier by the imaging optical system, and a controller for adjusting a light quantity of the light emitting element according to a position in the first direction of the imaging optical system for imaging the light from the light emitting element.

In the image forming apparatus thus constructed, the light quantity of the light emitting element is adjusted according to the position in the first direction of the imaging optical system for imaging the light from the light emitting element. Thus, a good exposure can be realized.

An embodiment of a line head according to another aspect of the invention comprises a head substrate on which light emitting elements are arranged at positions different in a first direction which is a moving direction of an image plane. The light emitting elements emit lights to form spots on the image plane. The respective light emitting elements arranged at the positions different in the first direction form the spots at positions of the image plane mutually different in the first direction. Light quantities of the light emitting elements are adjusted according to the positions in the first direction of the spots formed by the light emitting elements.

An embodiment of an image forming apparatus according to another aspect of the invention comprises a latent image carrier whose surface moves in a first direction and a line head that includes a head substrate on which light emitting elements are arranged at positions different in the first direction. The light emitting elements emit lights to form spots on the surface of the latent image carrier. The respective light emitting elements arranged at the positions different in the first direction form the spots at positions of the latent image carrier surface mutually different in the first direction. The latent image carrier surface carries spot latent images formed by the spots. Light quantities of the light emitting elements are adjusted according to the positions in the first direction of the spots formed by the light emitting elements.

In the embodiment (line head, image forming apparatus) thus constructed, the light quantities of the light emitting elements are adjusted according to the positions in the first direction of the spots formed by the light emitting elements. Accordingly, a good exposure can be realized by suppressing the occurrence of an exposure failure resulting from differences in the spot formation positions in the first direction.

Further, the application of the invention is particularly preferable for a construction in which the image plane is a latent image carrier surface carrying the spot latent images formed by the spots and the respective light emitting elements arranged at the positions different in the first direction are driven for light emission at timings in conformity with the movement of the latent image carrier surface, thereby forming a plurality of spot latent images aligned in a second direction orthogonal to or substantially orthogonal to the first direction.

Specifically, in the above line head, the respective light emitting elements arranged at the positions different in the first direction form spots on the latent image carrier surface at the positions mutually different in the first direction, and spot latent images are formed on the latent image carrier surface by these spots. Accordingly, the respective light emitting elements are driven for light emission at timings in conformity with the movement of the latent image carrier surface to align a plurality of spot latent images in the second direction. Thus, the spots are successively formed from the upstream ones in the first direction and the plurality of spot latent images aligned in the second direction are formed. However, these spot latent images tend to become larger with time. Accordingly, out of the plurality of spot latent images formed side by side in the second direction, those formed by the upstream spots in the first direction became larger than those formed by the downstream spots in the first direction in some cases since time after formation was longer. As a result, the sizes of the plurality of spot latent images formed side by side in the second direction varied in some cases. On the other hand, when the invention is applied, such a size variation of the spot latent images can be suppressed and a good exposure can be realized since the light quantities of the light emitting elements are adjusted according to the positions in the first direction of the spots formed by the light emitting elements.

At this time, out of two light emitting elements that form spots at positions different in the first direction, when the light emitting element that forms a spot at an upstream side in the first direction is defined as an upstream light emitting element and the one that forms a spot at a downstream side is defined as a downstream light emitting element, the light quantity of the upstream light emitting element may be adjusted to be smaller than that of the downstream light emitting element. In the case of such a construction, the variation of the plurality of spot latent images formed side by side in the second direction can be suppressed regardless of the enlargement of the spot latent images with time, wherefore a good exposure can be realized.

In a construction which comprises a developer that develops the spot latent images on the latent image carrier surface at a development position downstream of the respective spots formed on the latent image carrier surface in the first direction, the following problem may occur. In other words, distances in the first direction between the spots and the development position differ among the respective spots formed at the positions different in the first direction. Accordingly, the spot latent images formed by the upstream spots in the first direction and those formed by the downstream spots may differ in the size and the like at the development position. That is, the sizes and the like of the spot latent images varied at the development position in some cases. Thus, light quantities of the light emitting elements may be adjusted according to the distances in the first direction between the spots formed by the light emitting elements and the development position. This is because, by having such a construction, the variation of the spot latent images at the development position can be suppressed and good image formation can be performed by developing such spot latent images with less variation.

The invention is particularly preferably applied to a construction in which the image plane is a latent image carrier surface that has a curvature shape in a first-direction section and carries spot latent images formed by the spots. In other words, as described above, in the line head of another aspect of the invention, the respective light emitting elements arranged at the positions different in the first direction form spots on the latent image carrier surface at positions mutually different in the first direction. Accordingly, in the case where the image plane has a curvature shape, distances between the light emitting elements and the spots formed by the light emitting elements may differ among the respective light emitting elements arranged at the positions different in the first direction. However, the spot latent images formed by these spots may tend to become larger as element-spot distances become longer. Here, the element-spot distance is a distance between the light emitting element and the spot formed by the light emitting element. As a result, size variation occurred among the respective light emitting elements arranged at the positions different in the first direction in some cases. On the other hand, in the case of applying the invention, a good exposure can be realized by suppressing the size variation of the spot latent images since the light quantities of the light emitting elements are adjusted according to the positions in the first direction of the spots formed by the light emitting elements.

At this time, out of two light emitting elements adapted to form spots at positions mutually different in the first direction and having different element-spot distances, the light quantity of the light emitting element having the longer element-spot distance may be adjusted to be smaller than that of the light emitting element having the shorter element-spot distance. In the case of such a construction, the size variation of the spots can be suppressed regardless of the element-spot distances and a good exposure can be realized.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a latent image carrier that moves in a first direction;

an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system; and a controller that is adapted to control a light quantity of the light emitting element that emits a light to be imaged on the latent image carrier by the first imaging optical system in accordance with an imaging characteristic of the first imaging optical system, wherein a position of the first imaging optical system and a position of the second imaging optical system are different in the first direction and are different in a second direction orthogonal to the first direction, the light emitting element that emits the light to be imaged on the latent image carrier by the first imaging optical system is different from the light emitting element that emits the light to be imaged on the latent image carrier by the second imaging optical system, and the imaging characteristic is an area of the light imaged on the latent image carrier by the first imaging optical system.

2. The image forming apparatus according to claim 1, wherein the latent image carrier is a photosensitive drum.

3. An image forming apparatus comprising:

a latent image carrier that moves in a first direction;

an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system; and a controller that is adapted to control a light quantity of the light emitting element that emits a light to be imaged on the latent image carrier by the first imaging optical system in accordance with an imaging characteristic of the first imaging optical system, wherein a position of the first imaging optical system and a position of the second imaging optical system are different in the first direction and are different in a second direction orthogonal to the first direction, the light emitting element that emits the light to be imaged on the latent image carrier by the first imaging optical system is different from the light emitting element that emits the light to be imaged on the latent image carrier by the second imaging optical system, and the imaging characteristic is a diameter of the light imaged on the latent image carrier by the first imaging optical system.

4. An image forming apparatus comprising:

a latent image carrier that moves in a first direction;

an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system;

a controller that is adapted to control a light quantity of the light emitting element that emits a light to be imaged on the latent image carrier by the first imaging optical system in accordance with an imaging characteristic of the first imaging optical system; and a charger that charges the latent image carrier, wherein a position of the first imaging optical system and a position of the second imaging optical system are different in the first direction and are different in a second direction orthogonal to the first direction, the light emitting element that emits the light to be imaged on the latent image carrier by the first imaging optical system is different from the light emitting element that emits the light to be imaged on the latent image carrier by the second imaging optical system, the imaging characteristic is a position of the light imaged on the latent image carrier by the first imaging optical system, the first imaging optical system images the light from the light emitting element on the latent image carrier at a first position, the second imaging optical system images the light from the light emitting element on the latent image carrier at a second position which is more distant from the charger than the first position, and the controller sets the light quantity of the light emitting element that emits the light to be imaged by the first imaging optical system smaller than that of the light emitting element that emits the light to be imaged by the second imaging optical system.

5. An image forming apparatus, comprising:

a latent image carrier that moves in a first direction;

an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system, a controller that is adapted to control a light quantity of the light emitting element that emits a light to be imaged on the latent image carrier by the first imaging optical system in accordance with an imaging characteristic of the first imaging optical system; and a developer that develops a latent image formed on the latent image carrier by the exposure head, wherein a position of the first imaging optical system and a position of the second imaging optical system are different in the first direction and are different in a second direction orthogonal to the first direction, the light emitting element that emits the light to be imaged on the latent image carrier by the first imaging optical system is different from the light emitting element that emits the light to be imaged on the latent image carrier by the second imaging optical system, the imaging characteristic is a position of the light imaged on the latent image carrier by the first imaging optical system, and the imaging characteristic is a distance between an imaged position at which the light is imaged on the latent image carrier by the first imaging optical system and a development position at which the latent image formed by the light is developed by the developer.

6. An image forming apparatus, comprising:

a latent image carrier that moves in a first direction;

an exposure head that includes a first imaging optical system, a second imaging optical system that is distanced from the first imaging optical system in the first direction, a light emitting element that emits a light to be imaged on the latent image carrier by the first imaging optical system and a light emitting element that emits a light to be imaged on the latent image carrier by the second imaging optical system;

a controller that is adapted to control a light quantity of the light emitting element that emits a light to be imaged on the latent image carrier by the first imaging optical system in accordance with an imaging characteristic of the first imaging optical system;

a substrate on which the light emitting element that emits the light to be imaged on the latent image carrier by the first imaging optical system and the light emitting element that emits the light to be imaged on the latent image carrier by the second imaging optical system are arranged; and a light shielding member that is arranged between the substrate and the first and the second imaging optical systems, wherein a position of the first imaging optical system and a position of the second imaging optical system are different in the first direction and are different in a second direction orthogonal to the first direction, the light emitting element that emits the light to be imaged on the latent image carrier by the first imaging optical system is different from the light emitting element that emits the light to be imaged on the latent image carrier by the second imaging optical system, the controller is arranged on the substrate, and the light shielding member is provided with a first light guide hole and a second light guide hole, the first light guide hole being arranged between the light emitting element that emits the light to be imaged by the first imaging optical system and the first imaging optical system, the second light guide hole being arranged between the light emitting element that emits the light to be imaged by the second imaging optical system and the second imaging optical system.

* * * * *